US010867715B2

(12) United States Patent
Woloshun et al.

(10) Patent No.: US 10,867,715 B2
(45) Date of Patent: Dec. 15, 2020

(54) APPARATUS FOR PREPARING MEDICAL RADIOISOTOPES

(71) Applicant: Los Alamos National Security, LLC, Los Alamos, NM (US)

(72) Inventors: Keith A. Woloshun, Los Alamos, NM (US); Eric R. Olivas, Los Alamos, NM (US); Gregory E. Dale, Los Alamos, NM (US)

(73) Assignee: Triad National Security, LLC, Los Alamos, NM (US)

( * ) Notice: Subject to any disclaimer, the term of this patent is extended or adjusted under 35 U.S.C. 154(b) by 546 days.

(21) Appl. No.: 15/526,699

(22) PCT Filed: Nov. 17, 2015

(86) PCT No.: PCT/US2015/061133
§ 371 (c)(1),
(2) Date: May 12, 2017

(87) PCT Pub. No.: WO2016/081484
PCT Pub. Date: May 26, 2016

(65) Prior Publication Data

US 2017/0337997 A1 Nov. 23, 2017

Related U.S. Application Data

(60) Provisional application No. 62/080,589, filed on Nov. 17, 2014.

(51) Int. Cl.
*G21G 1/00* (2006.01)
*G21G 1/10* (2006.01)
(Continued)

(52) U.S. Cl.
CPC ..... *G21G 1/001* (2013.01); *G21G 1/10* (2013.01); *G21K 5/08* (2013.01); *H05H 6/00* (2013.01);
(Continued)

(58) Field of Classification Search
CPC ... G21G 1/001; G21G 1/10; G21G 2001/0036
See application file for complete search history.

(56) References Cited

U.S. PATENT DOCUMENTS 3,105,916 A 10/1963 Marker et al.
5,784,423 A 7/1998 Lidsky et al.
(Continued)

FOREIGN PATENT DOCUMENTS

CN 1922695 2/2007
CN 102084434 6/2011
(Continued)

OTHER PUBLICATIONS

Official Notice of Rejection (w/ Eng. translation) for related Japanese Application No. 2017-526622, dated Sep. 17, 2019, 18 pages.
(Continued)

*Primary Examiner* — Lily C Garner
(74) *Attorney, Agent, or Firm* — Klarquist Sparkman, LLP

(57) ABSTRACT

Apparatus for radioisotope production includes housing, a plurality of target disks inside the housing and a curved windows positioned convex inward toward the disks. During operation, coolant flows though the housing across the disks and windows while electron beams passes through the window and the disks. The window temperature increases, rising the fastest in the middle of the window where the electron beam hits the window. A flat window would buckle because the center would deform during thermal expansion against the relatively unaffected periphery, but the curved
(Continued)

window shape allows the window to endure high thermal and mechanical stress created by a combination of heating from the electron beam(s) and elevated pressure from coolant on the inside of the window. Such a window may be used for applications in which a pressurized coolant acts on only one side of the window.

20 Claims, 31 Drawing Sheets

(51) Int. Cl.
*G21K 5/08* (2006.01)
*H05H 6/00* (2006.01)

(52) U.S. Cl.
CPC ..... *G21G 2001/0036* (2013.01); *H05H 2006/002* (2013.01)

(56) References Cited

U.S. PATENT DOCUMENTS

| | | | | |
|---|---|---|---|---|
| 5,917,874 | A | 6/1999 | Schlyer et al. | |
| 6,208,704 | B1 | 3/2001 | Lidsky et al. | |
| 6,586,747 | B1 | 7/2003 | Erdman | |
| 2003/0152187 | A1* | 8/2003 | Ritter | G21C 1/30 376/194 |
| 2009/0016478 | A1 | 1/2009 | Hur et al. | |
| 2014/0348284 | A1* | 11/2014 | Diamond | G21G 1/06 376/186 |

FOREIGN PATENT DOCUMENTS

| | | |
|---|---|---|
| CN | 103733270 | 4/2014 |
| JP | 2000 180600 | 6/2000 |
| JP | 2001-133591 | 5/2001 |
| JP | 2004-514242 | 5/2004 |
| JP | 2010223943 | 10/2010 |
| JP | 2013-206726 | 10/2013 |
| WO | WO 2009/000076 | 12/2008 |

OTHER PUBLICATIONS

Extended European Search Report for related Application No. 15860848.9, dated Jul. 18, 2018, 8 pages.
First Office Action (with English translation) for related Chinese Application No. 201580070900.6, dated Sep. 10, 2018, 12 pages).
International Search Report and Written Opinion for related International Application No. PCT/US2015/061133, 7 pages, dated Mar. 4, 2016.

* cited by examiner

LOAD DESCRIPTIONS

| DESIGN LOAD PARAMETER | DESCRIPTION |
|---|---|
| $P$ | INTERNAL AND EXTERNAL SPECIFIED DESIGN PRESSURE |
| $P_S$ | STATIC HEAD FROM LIQUID OR BULK MATERIALS (E.G. CATALYST) |
| $D$ | DEAD WEIGHT OF THE VESSEL, CONTENTS, AND APPURTENANCES AT THE LOCATION OF INTEREST, INCLUDING THE FOLLOWING:<br>● WEIGHT OF VESSEL INCLUDING INTERNALS, SUPPORTS (E.G. SKIRTS, LUGS, SADDLES, AND LEGS), AND APPURTENANCES (E.G. PLATFORMS, LADDERS, ETC.)<br>● WEIGHT OF VESSEL CONTENTS UNDER OPERATING AND TEST CONDITIONS<br>● REFRACTORY LININGS, INSULATION<br>● STATIC REACTIONS FROM THE WEIGHT OF ATTACHED EQUIPMENT, SUCH AS MOTORS, MACHINERY, OTHER VESSELS, AND PIPING |
| $L$ | ● APPURTENANCE LIVE LOADING<br>● EFFECTS OF FLUID MOMENTUM, STEADY STATE AND TRANSIENT |
| $E$ | EARTHQUAKE LOADS (SEE ASCE 7 FOR THE SPECIFIC DEFINITION OF THE EARTHQUAKE LOAD, AS APPLICABLE) |
| $W$ | WIND LOADS |
| $W_td$ | IS THE PRESSURE TEST WIND LOAD CASE. THE DESIGN WIND SPEED FOR THIS CASE SHALL BE SPECIFIED BY THE OWNER-USER |
| $S_1$ | SNOW LOADS |
| $T$ | IS THE SELF-RESTRAINING LOAD CASE (I.E. THERMAL LOADS, APPLIED DISPLACEMENTS). THIS LOAD CASE DOES NOT TYPICALLY AFFECT THE COLLAPSE D LOAD, BUT SHOULD BE CONSIDERED IN CASES WHERE ELASTIC FOLLOW-UP CAUSES STRESSES THAT DO NOT RELAX SUFFICIENTLY TO REDISTRIBUTE THE LOAD WITHOUT EXCESSIVE DEFORMATION |

- "P" PRESSURE IN THE HELIUM SPACE UNDER FAULT CONDITION
- "$P_S$" STATIC HEAD FROM HELIUM (NEGLIGIBLE)
- "D" DEAD WEIGHT OF THE SYSTEM
- "T" THERMAL DISPLACEMENT

FOR EACH ANALYSIS THE CODE PROVIDES THE *LOAD COMBINATION* AND *FACTORED LOAD CASES:*

ELASTIC STRESS ANALYSIS METHOD

LOAD COMBINATION: $P+P_S+D$

ELASTIC PLASTIC STRESS ANALYSIS METHOD

GLOBAL Criteria_I $2.1(P+P_S+D+T)$

FIG. 13

| STRESS CATEGORY | PRIMARY | | | SECONDARY MEMBRANE PLUS BENDING | PEAK |
|---|---|---|---|---|---|
| | GENERAL MEMBRANE | LOCAL MEMBRANE | BENDING | | |
| DESCRIPTION (FOR EXAMPLES, SEE TABLE 5.2) | AVERAGE PRIMARY STRESS ACROSS SOLID SECTION. EXCLUDES DISCONTINUITIES AND CONCENTRATIONS. PRODUCED ONLY BY MECHANICAL LOADS. | AVERAGE STRESS ACROSS ANY SOLID SECTION. CONSIDERS DISCONTINUITIES BUT NOT CONCENTRATIONS. PRODUCED ONLY BY MECHANICAL LOADS. | COMPONENT OF PRIMARY STRESS PROPORTIONAL TO DISTANCE FROM CENTROID OF SOLID SECTION. EXCLUDES DISCONTINUITIES AND CONCENTRATIONS. PRODUCED ONLY BY MECHANICAL LOADS. | SELF-EQUILIBRATING STRESS NECESSARY TO SATISFY CONTINUITY OF STRUCTURE. OCCURS AT STRUCTURAL DISCONTINUITIES. CAN BE CAUSED BY MECHANICAL LOAD OR BY DIFFERENTIAL THERMAL EXPANSION. EXCLUDES LOCAL STRESS CONCENTRATIONS. | 1. INCREMENT ADDED TO PRIMARY OR SECONDARY STRESS BY A CONCENTRATION (NOTCH). 2.CERTAIN THERMAL STRESSES WHICH MAY CAUSE FATIGUE BUT NOT DISTORTION OF VESSEL SHAPE. |
| SYMBOL | $P_m$ | $P_L$ | $P_b$ | Q | F |

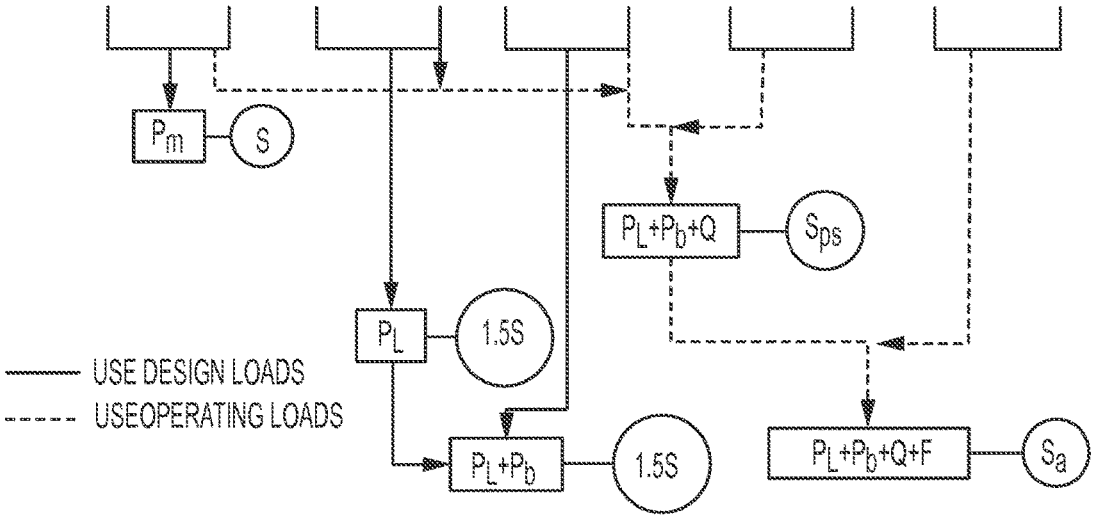

FIG. 14

APPARATUS FOR PREPARING MEDICAL RADIOISOTOPES

CROSS-REFERENCE TO RELATED APPLICATIONS

This application is the U.S. National Stage of International Application No. PCT/US2015/061133, filed Nov. 17, 2015, which claims the benefit of U.S. Provisional Application No. 62/080,589, filed on Nov. 17, 2014, which is herein incorporated by reference in its entirety.

ACKNOWLEDGEMENT OF GOVERNMENT SUPPORT

This invention was made with government support under Contract No. DE-AC52-06NA25396 awarded to the U.S. Department of Energy. The government has certain rights in the invention.

PARTIES TO JOINT RESEARCH AGREEMENT

The research work described here was performed under a Cooperative Research and Development Agreement between Los Alamos National Security, LLC and NorthStar Medical Radioisotopes, LLC, under CRADA number LA11C10660.

FIELD

This application relates generally to systems, apparatuses, and methods for preparing radioisotopes such as Mo-99.

BACKGROUND

Technetium-99m ("Tc-99m") is the most commonly used radioisotope in nuclear medicine. Tc-99m is used in approximately two-thirds of all imaging procedures performed in the United States. Tens of millions of diagnostic procedures using Tc-99m are undertaken annually. Tc-99m is a daughter isotope produced from the radioactive decay of molybdenum-99 ("Mo-99"). Mo-99 decays to Tc-99m with a half-life of 66 hours.

The vast majority of Mo-99 used in nuclear medicine in the U.S. is produced in aging foreign reactors. Many of these reactors still use solid highly enriched uranium ("HEU") targets to produce the Mo-99. HEU has a concentration of uranium-235 ("U-235") of greater than 20%. Maintenance and repair shutdowns of these reactors have disrupted the supply of Mo-99 to the U.S. and to most of the rest of the world. The relatively short half-life of the parent radioisotope Mo-99 prohibits the build-up of reserves. One of the major producers, The National Research Reactor in Canada, will cease regular production in 2016.

SUMMARY

Technologies for producing Mo-99 that do not involve the use of HEU may involve, for example, exposing a target (or targets) of molybdenum-100 to an electron beam. The interaction with the beam results in conversion of some of the molybdenum-100 target material into molybdenum-99. The molybdenum-100 target material may be present, for example, in the form of target disks inside a disk holder, with the disks oriented perpendicular to a beam direction. The beam can first pass through a window and then through the nearest target disk, and then through the next nearest disk, and so on. The interaction of the beam with the window and targets can heat the window and the targets, so a coolant (e.g. helium gas) can be used to remove heat from the window and/or the targets as the beam irradiates the targets.

Typical windows are flat, but flat windows can be problematic because a high heat deposition rate and pressure on the window from coolant gas can contribute to high stresses, and an energetic beam can heat the window non-uniformly, predominantly in the center where the beam passes through the window. The center of the window can thus expand thermally against a relatively unmoving perimeter. Under these conditions, the expanding center can bow out of the plane of the original flat window because heating from the beam in combination with pressurized coolant creates stresses on the window that cause the window to deform, and this can cause the window to fail.

Accordingly, technologies are disclosed herein for minimizing the stresses on the window during electron beam irradiation while the window and the targets are being cooled from inside the target disk holder.

In some disclosed technologies, an apparatus for producing radioisotopes can include a housing, a disk holder inside the housing, and a plurality of target disks oriented substantially parallel to one another inside the disk holder. The apparatus can also include a first curved window and a second curved window. These windows can be positioned on opposite sides of the disk holder with their curved surfaces oriented inward toward the disks inside the disk holder. In other embodiments, only one window is provided on one side of the target, or more than two windows are provided, such as on three or more sides of the target.

During operation of embodiments having two curved windows on opposite sides of the disk holder, a first electron beam can pass through the first window and then through the target disks, resulting in isotope production. A second electron beam may also pass through the second window and then through the target disks, resulting in additional isotope production. Beam irradiation results in heating the windows and the target disks. One or more inlets in the disk holder allow a coolant from the housing to enter the disk holder and cool the disks and/or the curved windows. Outlets in the disk holder allow the coolant to exit the disk holder. The curved window shape reduces stresses on the windows caused by beam-induced heating and coolant pressure, compared to non-curved windows.

In some embodiments, an apparatus for producing Mo-99 includes a housing, a disk holder inside the housing, and a plurality of target disks of molybdenum-100. The target disks are oriented substantially parallel to one another inside the disk holder. The apparatus also includes a first curved window and a second curved window. The first curved window and second curved window are positioned on opposite sides of the disk holder with their respective curved surfaces oriented inward toward the disks inside the disk holder. During operation, a first electron beam passes through the first window and then through the target disks made of molybdenum-100, resulting in production of the radioisotope molybdenum-99. A second electron beam may also pass through the second window and then through the target disks of molybdenum-100, resulting in additional radioisotope production of molybdenum-99. The apparatus also includes coolant that contacts the target disks and/or the inner surfaces of the two curved windows. During operation, as the electron beam(s) pass through the curved windows and irradiate the target disks of molybdenum-100, the coolant flows through the housing to the disk holder where it cools the disks and the windows. The curved window shape reduces stresses on the windows caused by beam-induced heating and coolant pressure, compared to flat windows.

The foregoing and other objects, features, and advantages of the disclosed technology will become more apparent from the following detailed description, which proceeds with reference to the accompanying figures.

BRIEF DESCRIPTION OF THE DRAWINGS

FIG. 13 shows load description and analyzed finite element cases.

FIG. 14 shows stress categories and limits of equivalent stress.

DETAILED DESCRIPTION

Figure 1A:
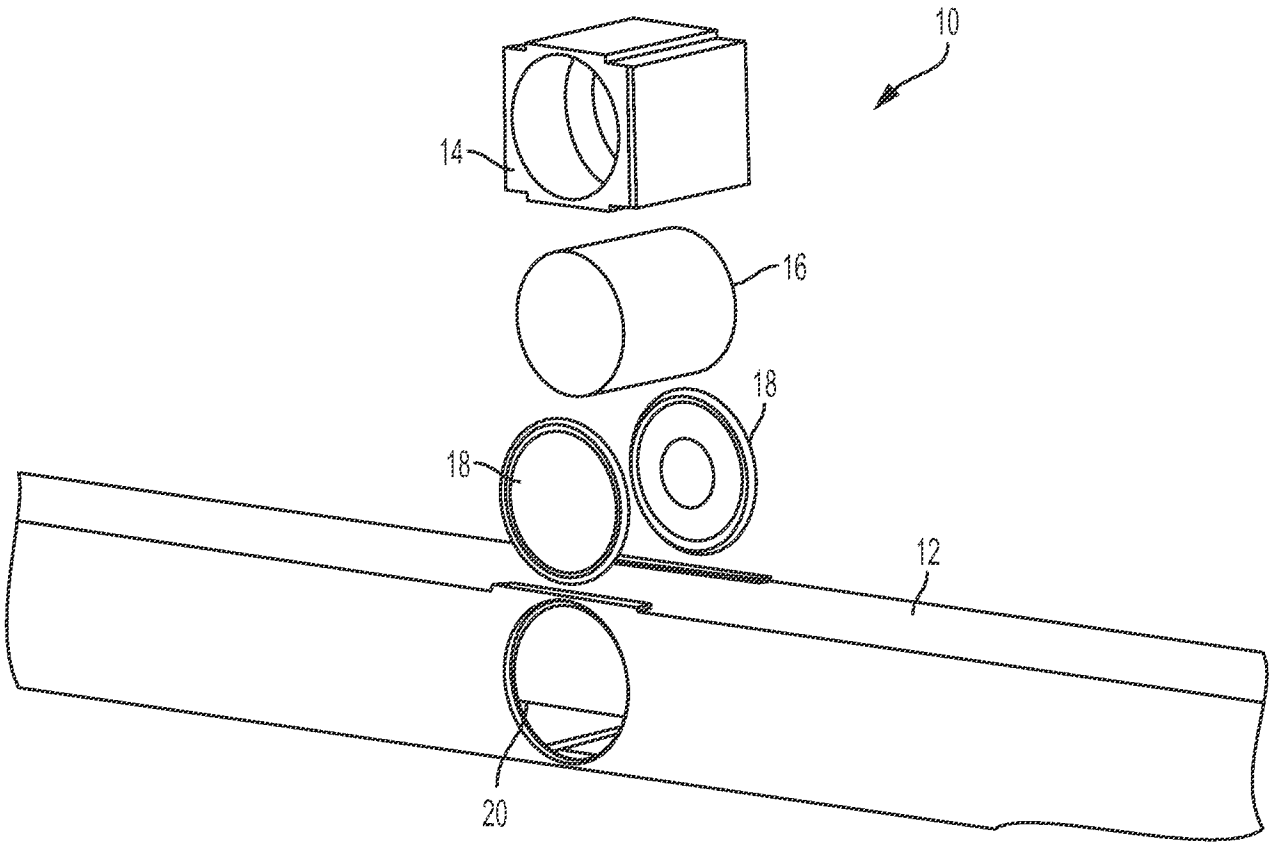
FIG. 1A is an exploded isometric view of an exemplary apparatus for preparing radioisotopes including a housing, target disk holder, target disks, and two curved windows oriented with their curvature toward the target disks (i.e. convex into the housing).

Systems, apparatuses, and methods for producing radioisotopes are disclosed herein. Disclosed systems can include an apparatus operable to hold one or more targets to be irradiated while also operable to conduct a coolant past the targets and other portions of the apparatus that can be heated by the irradiation. Exemplary apparatuses disclosed herein can include an elongated housing, a target holder, one or more curved windows and one or more targets. The targets are held by the target holder within the housing in a desired orientation such that applied radiation passes through the curved windows and into or through the targets to produce desired radioisotopes in the targets. The targets can comprise any number of individual target units, such as disks or spheres, arranged in a specific manner for interaction with applied radiation. The housing is also configured to conduct a coolant through the target holder, over the targets, and/or past at least the inner surfaces of the curved windows to draw away heat generated by the irradiation. The windows can have a curvature that shapes an incoming radiation beam in a desired way to for effectively produce radioisotopes in the targets.

Some exemplary apparatuses include a housing, a disk holder inside the housing, and a plurality of target disks oriented substantially parallel to one another inside the disk holder. The apparatus also includes a first curved window and a second curved window that are positioned on opposite sides of the disk holder with their respective curved surfaces oriented inward toward the disks inside the disk holder. During operation, a first electron beam passes through the first window and then through the target disks, resulting in isotope production. A second electron beam may also pass through the second window and then through the target disks, resulting in additional isotope production. Beam irradiation results in heating the windows and the target disks. Inlets in the disk holder allow coolant from the housing to enter the disk holder and cool the disks and the curved windows. Outlets in the disk holder allow the coolant to exit the disk holder. The curved window shape can help shape the beam and can help minimize stresses on the windows caused by beam-induced heating and coolant pressure.

In a particular embodiment, an apparatus is provided for producing Mo-99. The apparatus includes a housing, a disk holder inside the housing, and a plurality of target disks of molybdenum-100 held in the disk holder. The target disks are held oriented substantially parallel to one another inside the disk holder with narrow spaces between the disks. The apparatus also includes a first curved window and a second curved window that are positioned on opposite sides of the disk holder with their respective curved surfaces oriented inward toward the disks inside the disk holder. During operation, a first electron beam passes through the first window and then through the target disks made of molybdenum-100, resulting in production of the radioisotope molybdenum-99. A second electron beam may also pass through the second window and then through the target disks of molybdenum-100, resulting in additional radioisotope production of molybdenum-99. A first electron beam from an electron beam source passes through the first curved window. At the same time, or later, a second electron beam passes through the second curved window. As the electron beam(s) pass through the windows and then through the target disks of molybdenum-100, a flow of a coolant passes through the housing to the disk holder where it cools the disks and the windows.

In any of the disclosed embodiments, a radius of curvature can be imparted to the window(s) which is convex inward into the passing coolant gas stream. This window shape enhances coolant flow over the convex inner window surface, which improves heat transfer and reduces the window temperature. The curved window shape can also result in a reduction in mechanical stress and in pressure-induced thermal stress.

Figure 1B:
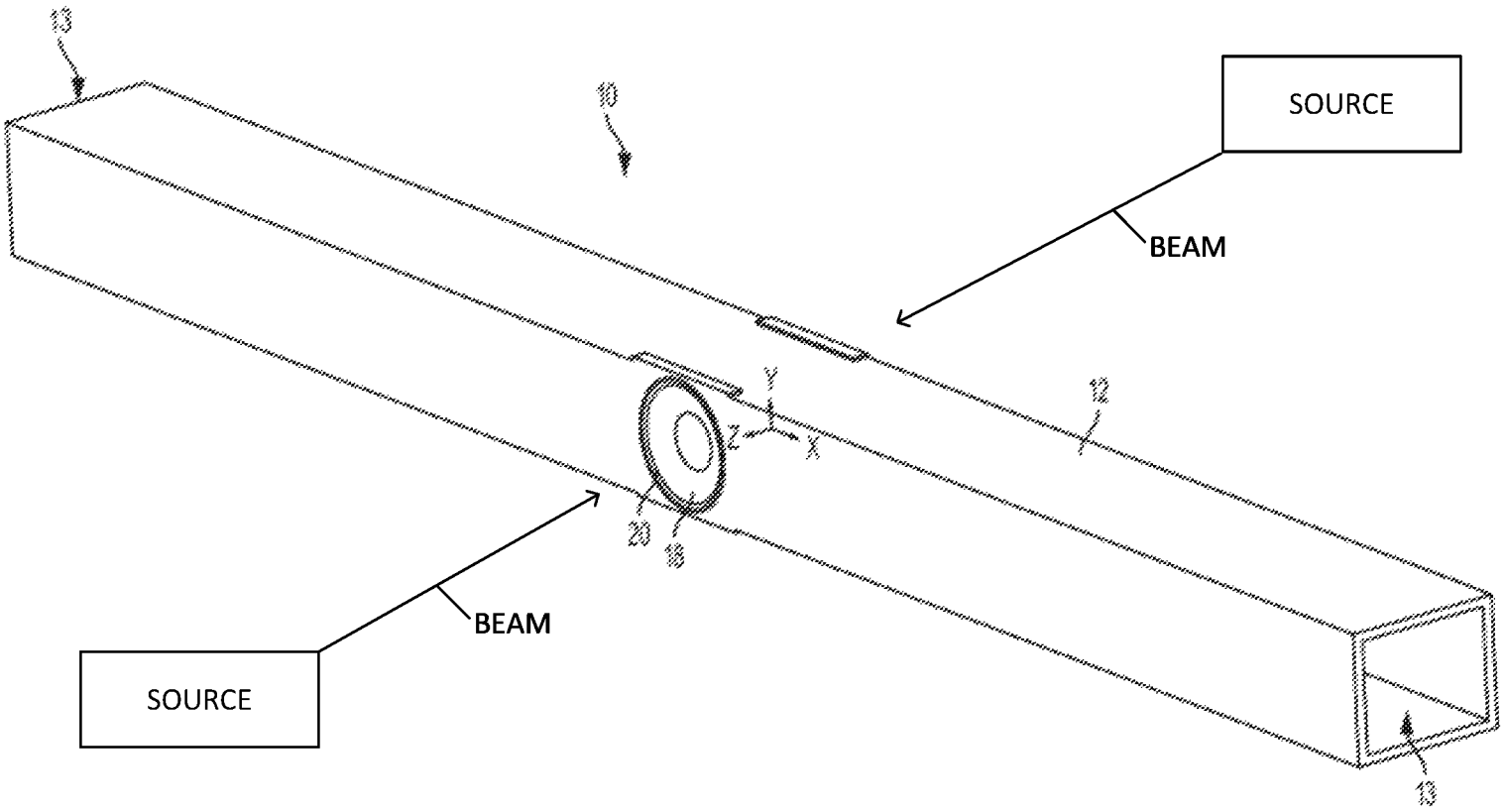
FIG. 1B is an assembled view of the apparatus of FIG. 1A.

FIGS. 1A and 1B show an exemplary apparatus 10 that includes a housing 12, a target holder 14, a generally cylindrical stack of target disks 16 (e.g., 50 Mo-99 disks), and two opposing curved windows 18. Curved windows 18 are convex inward (i.e. with a convex curved surface oriented facing inward toward the target disks 16 inside the target holder 14 and a concave curved outer surface facing away from the target). As shown in FIG. 1B, the housing 12 can be generally tubular and can be elongated in a direction perpendicular to the radiation beam axis. The housing 12 can have a rectangular cross-section, or other cross-sectional shapes. The housing 12 can include circular openings 20 sized to receive the windows 18 with a corresponding shape.

Figure 2A:
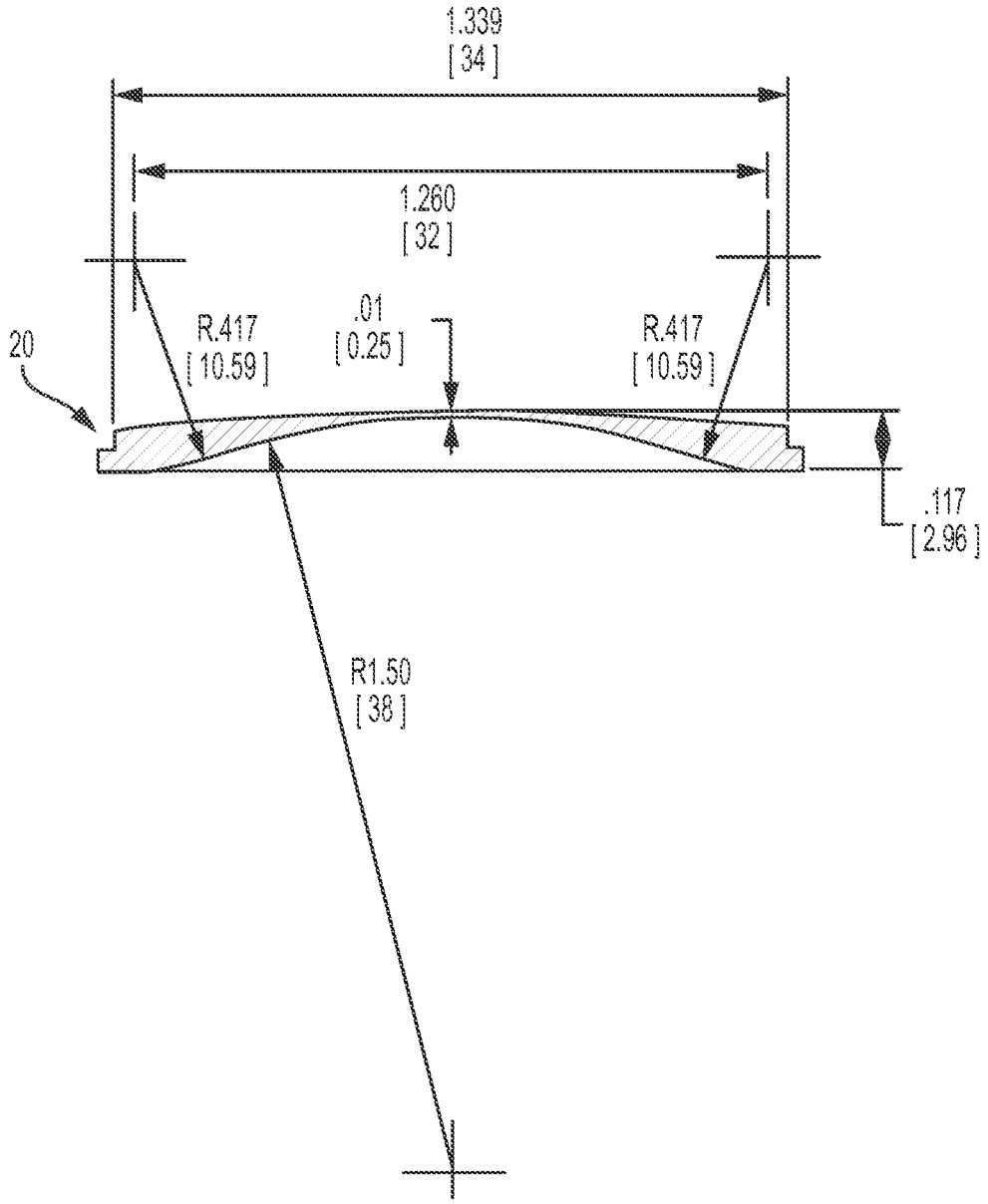
FIG. 2A is a cross-sectional view of an exemplary curved window, showing exemplary dimensions. The dimensions are provided in inches (1.339 inches, 1.230 inches, and 0.01 inches to name a few), as well as in millimeters (34, 32, 0.25) which appear in brackets in FIG. 2A. The value for the radius of curvature shown is 1.50 inches [38 millimeters]. The window diameter, thickness as a function of radius, and overall dimensions will change with the relative mechanical and thermal stresses that are created during usage when an electron beam passes through the window while coolant flows through the apparatus to cool the irradiated disks and the window from the inside of the apparatus.
Figure 2B:
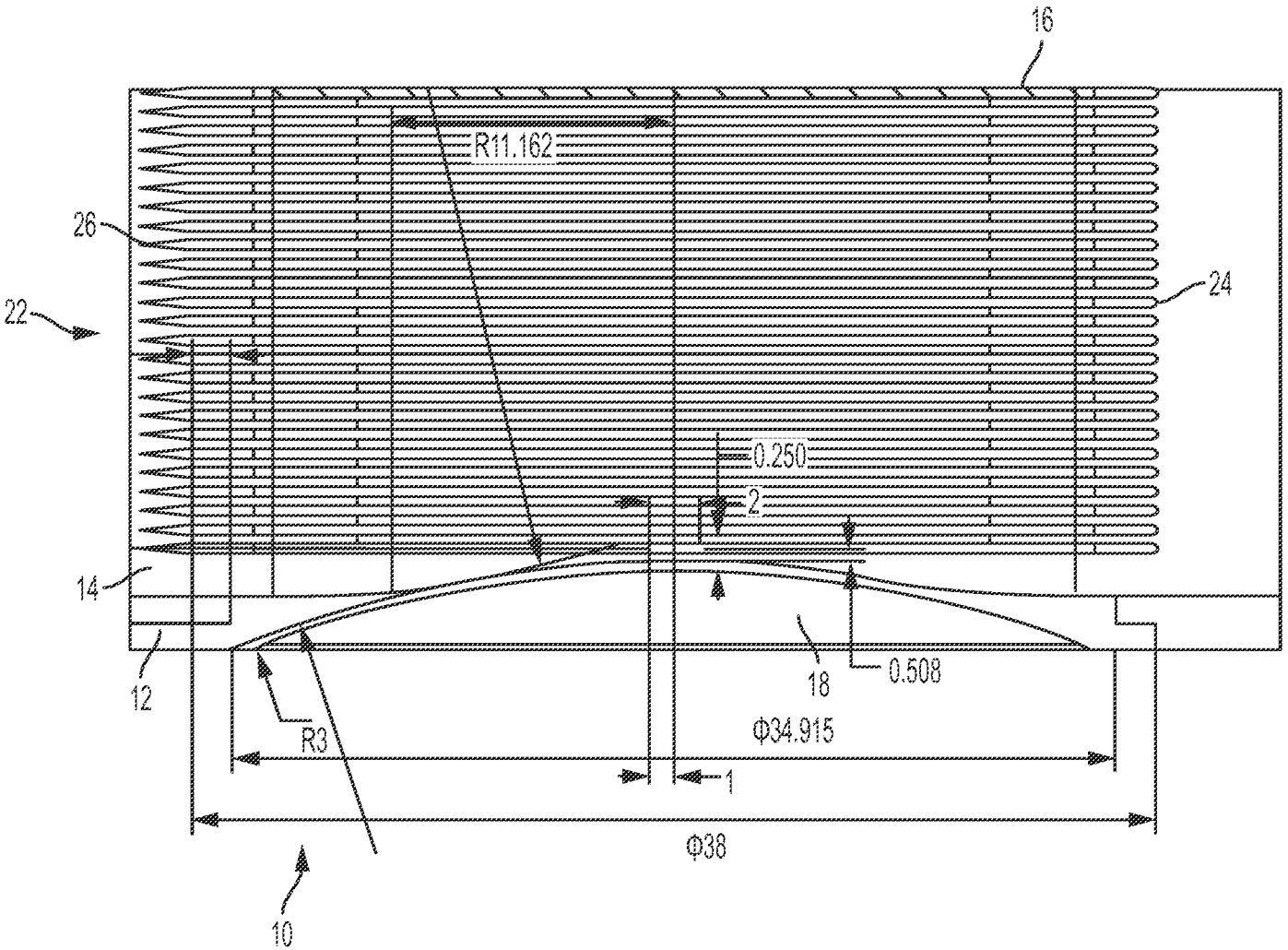
FIG. 2B shows details of an exemplary curved window and target holder for the apparatus of FIG. 1B.
Figure 2C:
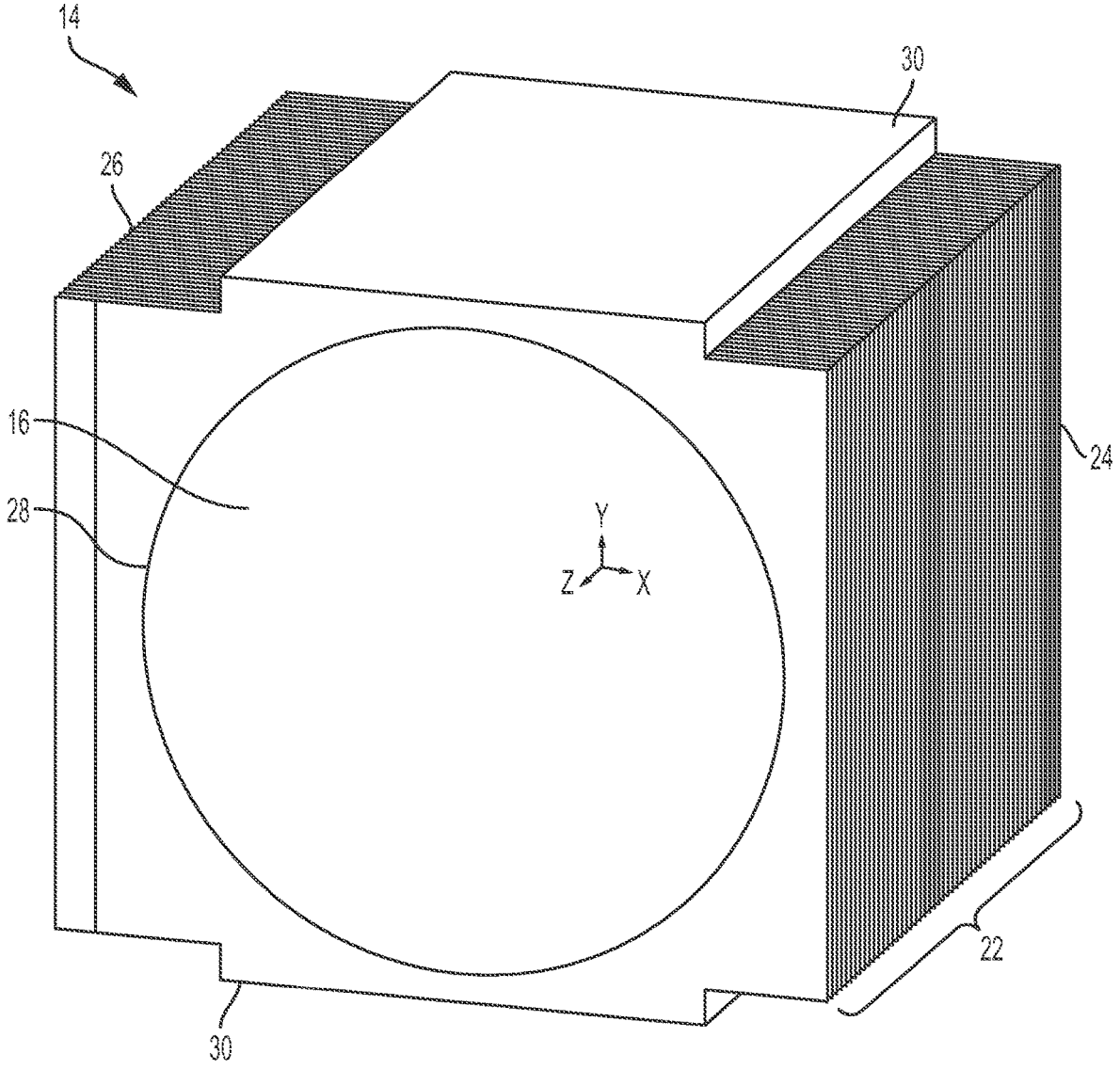
FIG. 2C is an isometric view on an exemplary target holder and target for the apparatus of FIG. 1B.

As shown in FIG. 2C, the target holder 14 can comprise a generally cuboid frame. The holder 14 can comprise openings 28 passing through the holder that are in alignment with the two windows 18 and the two openings 20 in the housing. The stack of target disks 16 is placed inside the holder 14 in the openings 28 with the disks aligned with the openings in the holder 28 and the windows 18. The target holder 14 can include a plurality of fins 22 spaced slightly apart from each other, wherein each fin 22 includes one of the openings 28 and holds one of the targets. The holder 14 includes coolant flow channels extending between the fins 22. The fins 22 can include a rounded, or bull nosed, inflow end 24 and a pointed diffuser outflow end 26 to reduce the coolant pressure drop across the targets between the inflow end 24 and the outflow end 26. The plurality if fins 22 can be held together via upper and low connection plates 30, as shown in FIG. 2C. Spaces are also provided between the inner surfaces of the windows 18 and the first and last target disk to allow coolant flow the flow to pass over the inner surfaces of the windows as well as the disks. FIG. 2B provides exemplary dimensions for the target holder 14 and the window 18.

The curved shape of the windows 18 can reduces stresses on the windows caused by beam-induced heating and coolant pressure, compared to non-curved window shapes or other curved window shapes. FIG. 2A shows a cross-sectional view of an exemplary window 18 with exemplary dimensions. The dimensions are provided in inches (1.339 inches, 1.230 inches, and 0.01 inches to name a few), as well as in millimeters (34, 32, 0.25) which appear in brackets in FIG. 2A. The value for the radius of curvature shown is 1.50 inches [38 millimeters]. The window diameter, thickness as a function of radius, and overall dimensions can change with the relative mechanical and thermal stresses that are created during usage when an electron beam passes through the window while coolant flows through the apparatus to cool the irradiated disks and the window from the inside of the apparatus.

Figure 1C:
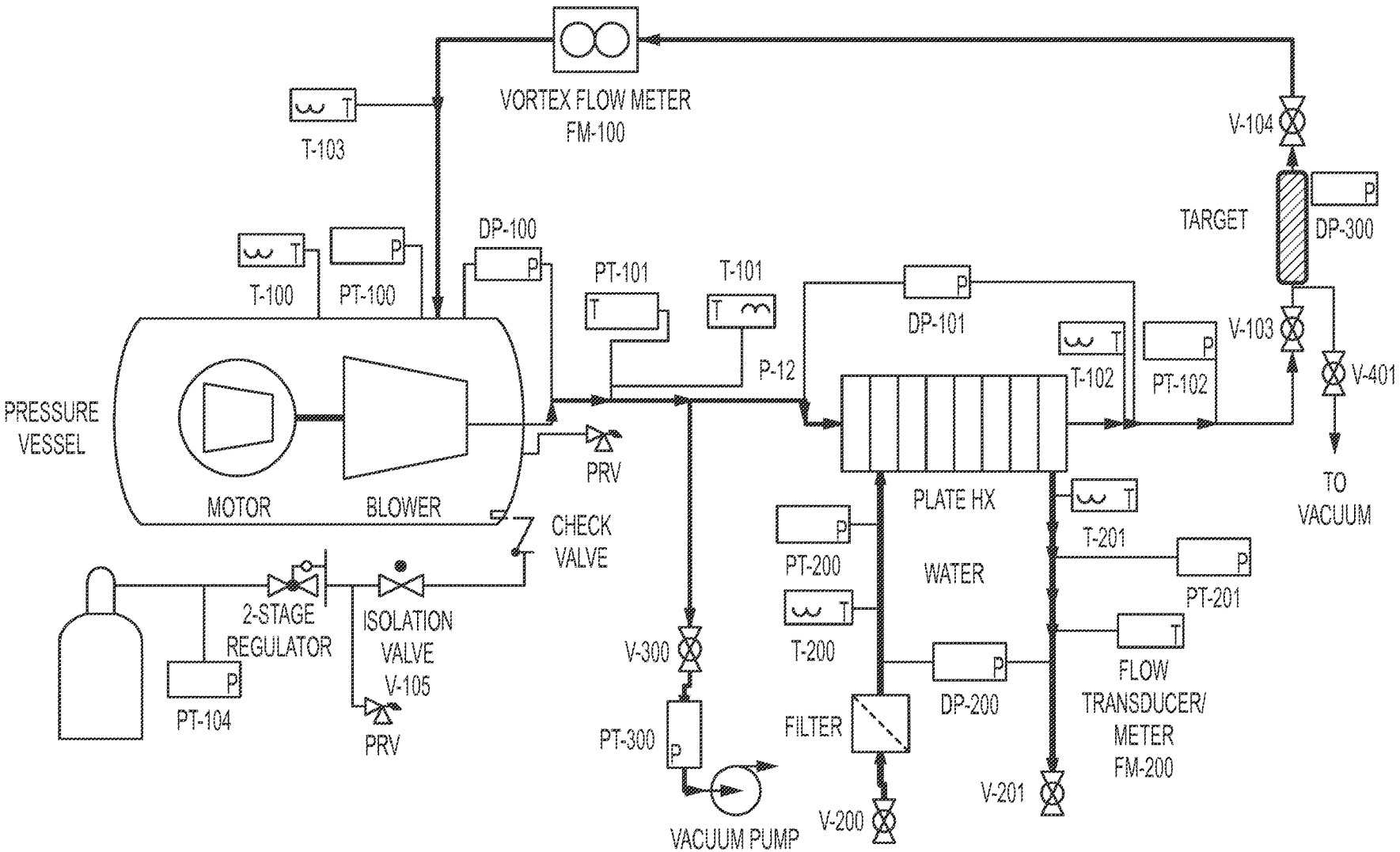
FIG. 1C is a schematic representation of an exemplary system for preparing radioisotopes.

The apparatus 10 is an example of various apparatuses for preparing radioisotopes while utilizing a coolant flow to continuously remove the heat generated by applied radiation. FIG. 1C is schematic diagram illustrating an exemplary coolant system that can be used with the apparatus 10 or other similar apparatus. The coolant system can utilize various coolant materials, such as helium to remove heat from the target, windows, and/or other apparatus components. The coolant system can apply the coolant to the apparatus 10 at a desired pressure and flow rate and can exchange the heat extracted from the apparatus to a heat sink (e.g., a body of water) or some other destination. In some embodiments, the cooling system can comprise a closed loop helium-based cooling system with an inlet mass flow rate of about 217 gm/s and an inlet pressure of about 2.068 MPa. The inlet mass flow rate and inlet pressure can be applied at the inflow ends 24 of the target holder, for example. As shown in FIG. 1B, the housing 12 can include an elongated tubular body, with end openings 13. The end openings 13 can be coupled to the coolant system to conduct coolant in through one of the openings 13, through the target holder 14, and out through the other opening 13.

In alternative embodiments, the target can have various different configurations. For example, FIGS. 24A-24D show an exemplary single-piece target 40 having a generally cylindrical overall shape with a plurality of cross-channels to allow for coolant flow through the target. The target 40 can be arranged with axial ends 42 facing the curved windows, and the solid upper and lower portions 44 positioned above and below the coolant flow. The flow channels can comprise various sizes and shapes in different portions of the target 40. For example, the target 40 can include broader slot-type flow channels 46 nearer to the axial ends 42, narrower slot-type flow channels 48 closer to the axial center, and/or pin-hole type flow channels 50 in the axially central portion. The channels 46 and 48 can extend vertically between the upper and lower solid portions 44, while the pin-hole type channels 50 can have a shorter height and be stacked with several in the same vertical plane. The different sizes and shapes of the flow channels can account for variations in heating rates across the target, with greater coolant flow and/or surface area in areas with greater heating from the irradiation. The exemplary target 40 is configured to be irradiated from both axial ends, and is therefore axially symmetrical, though other embodiments can be asymmetric, such as when irradiated from only one axial end.

Figure 25:
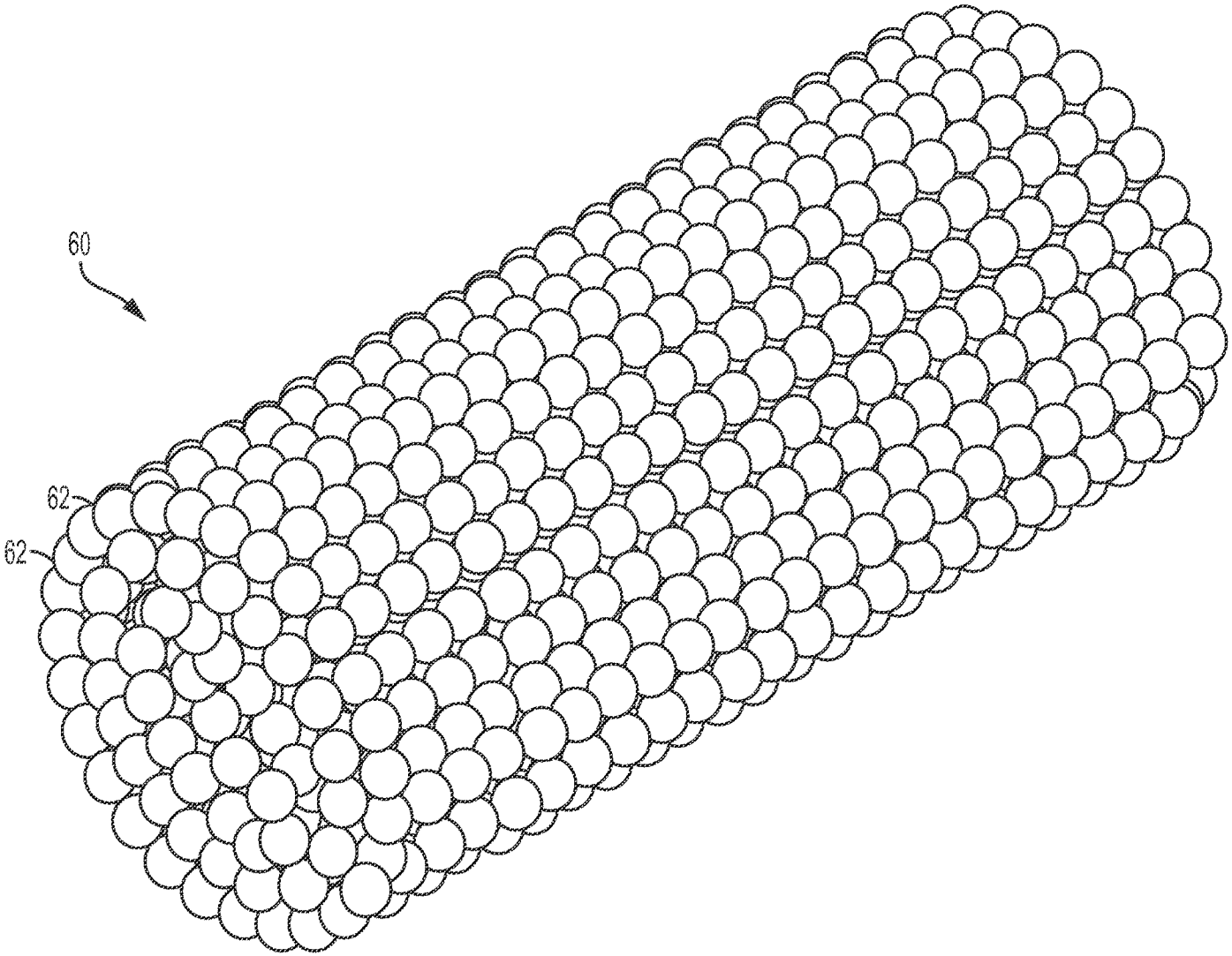
FIG. 25 is an isometric view of an exemplary target comprising a plurality of small spherical elements.

FIG. 25 illustrates another exemplary target 60 having a generally cylindrical overall shape and comprising a plurality of small spherical target elements 62. The target 60 can be oriented with radiation coming from one or both axial ends. The spaces between the spherical elements 62 can allow for coolant flow through the entire target. The target 60 can include a spherical outer casing or holder that holds the elements 62 in the desired packed form. The outer casing or holder can comprise a mesh, screen, or other at least partially perforated material to allow coolant flow through it into the target. The coolant flow can be perpendicular to the axis of the cylindrical overall shape. In other similar embodiments, the target can comprise a rectangular, e.g., square cross-section, overall shape comprised of packed small spherical elements. The rectangular shape can provide a more even coolant flow distribution passing through the target. The spherical elements can be packed in different manners to adjust their overall density and adjust the relative volumes and configurations of the open spaces between the spheres. In still other embodiments, the target can comprise a sponge-like or porous material that is integral as one piece but includes passageways for pressurized coolant to make its way through the target.

In still other embodiments, the more than two curved windows can be included in the housing to permit irradiation of a target from more than two different directions. For example, a rectangular cross-section housing can include four windows, one on each of the four sides, with the coolant flowing perpendicular to the center axes of all four curved windows. In such an embodiment, the target can comprise a cuboid shape, for example, with four flat surfaces facing the four windows and two other surfaces facing the coolant inflow and coolant outflow. The cuboid target can include passageways aligned with the coolant flow directions, or other passageways/openings to facilitate coolant effectiveness. In other embodiments, the target can comprise a spherical or ovoid shaped target. Any shaped target can be used. Accordingly, the target holder have any corresponding shape to hold the target relative to the window(s) and facilitate coolant flow over and/or through the target within the housing.

Design Methodology for an Exemplary Convex Beam Entry Window

Beam entry windows for any type of charged particle beam can be subjected to volumetric heating via energy dissipation caused by particle/window material interactions. With the exception of very thin windows that are made of low beam interaction materials (typically material having low molecular weight(s)), a typical embodiment window requires active cooling, and coolants are of necessity pressurized to some degree to produce flow. The window is then stressed by two mechanisms: 1) mechanical stress from the pressure load, and 2) thermal stress from temperature gradients in the material. These stresses must be kept below some limit to prevent window failure. While less conservative limits may be adopted in some cases, the generally accepted and often required standard for allowable stress criteria is the ASME Boiler and Pressure Vessel Code (hereinafter referred to as the "CODE").

The curved windows of the present embodiments can accommodate situations in which a flat window is not acceptable by this standard. The curved windows of the present embodiments can have complex curvatures and/or variable thickness, so the appropriate section of the CODE is Section VIII, Part 5 (which is incorporated by reference herein), which specifies requirements for applications requiring design-by-analysis methodology, typically finite element computational methods. This section of the CODE describes in detail how the various stress types (membrane, bending, and secondary (thermal) are to be compared to allowable stress, singularly and in combination.

Determining the parameters/dimensions of a curved window for a particular apparatus set up can be done using an iterative approach. The window diameter can generally be defined by the particle beam dimensions and is typically a value near to twice the full width at half maximum (FWHM) of a Gaussian beam profile. For other beam profiles, it can depend on the rate of volumetric heating decrease. Curving the window has the effect of reducing both the thermal and the mechanical stress, but the curvature does have an impact on the coolant flow which must also be considered.

The iterative process for producing a curved window for a given apparatus can begin with a flat window design, such as with variable thickness to minimize thermal stress. Convex curvature can then be introduced at the point where no acceptable solution can be obtained with a flat window. The window is convex, curved into the target and the coolant is introduced in a manner to ensure good coolant flow across the window. The curvature can be systematically adjusted, optionally along with the thickness, which generally increases radially to reduce mechanical stresses. The stress can be compared to the CODE defined Limits of Equivalent Stress as defined in the Section VIII, Part 5. Depending on the relative contribution of the stress type to the net equivalent stress, the thickness or curvature, or both the thickness and curvature may need to be adjusted and calculations repeated. By this process, a curved window profile can be obtained, pending fabrication and testing.

Figure 2D:
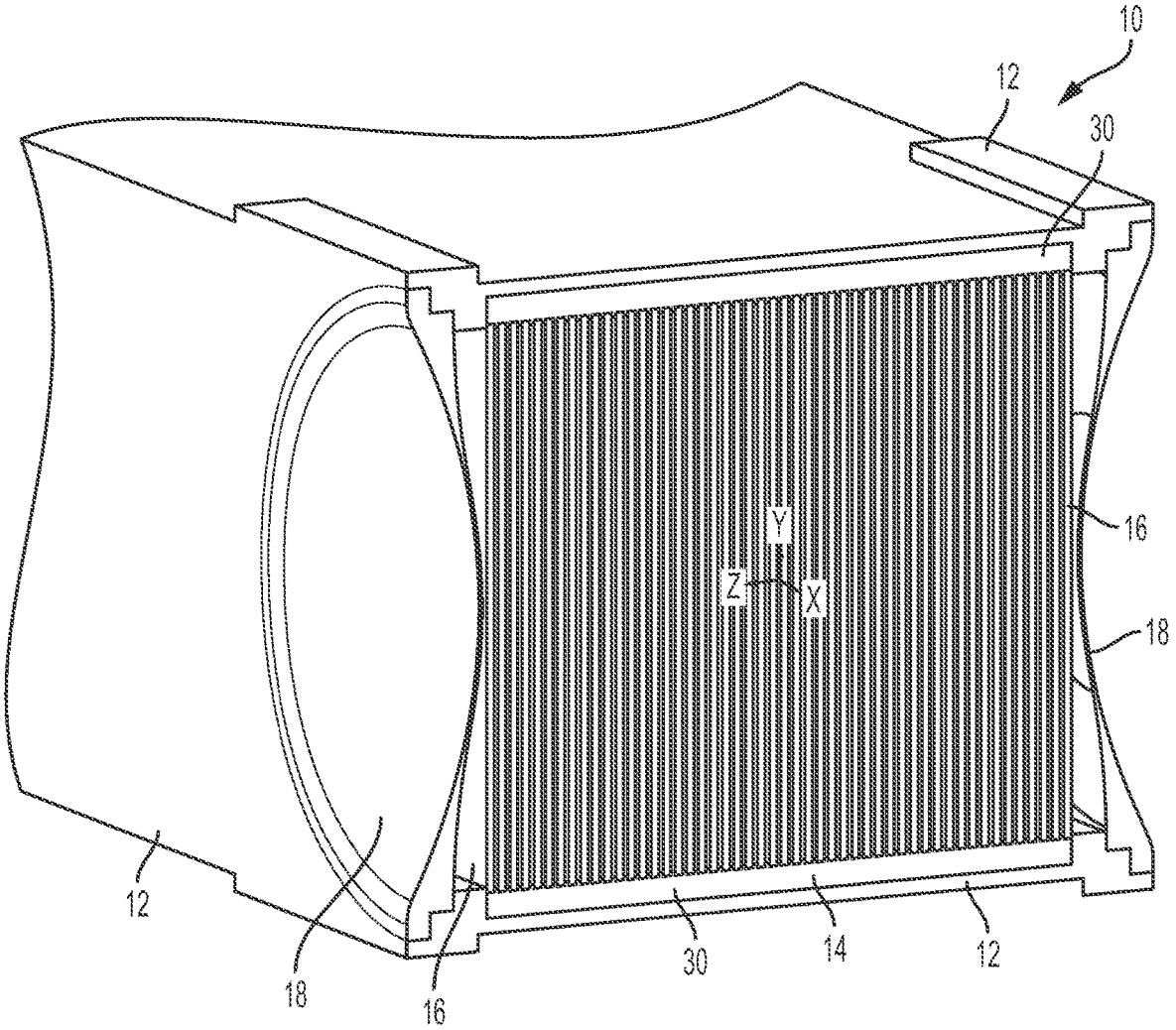
FIG. 2D is a cross-sectional view of the apparatus of FIG. 1B taken along a plane perpendicular to the coolant flow direction through the apparatus.
Figure 3:
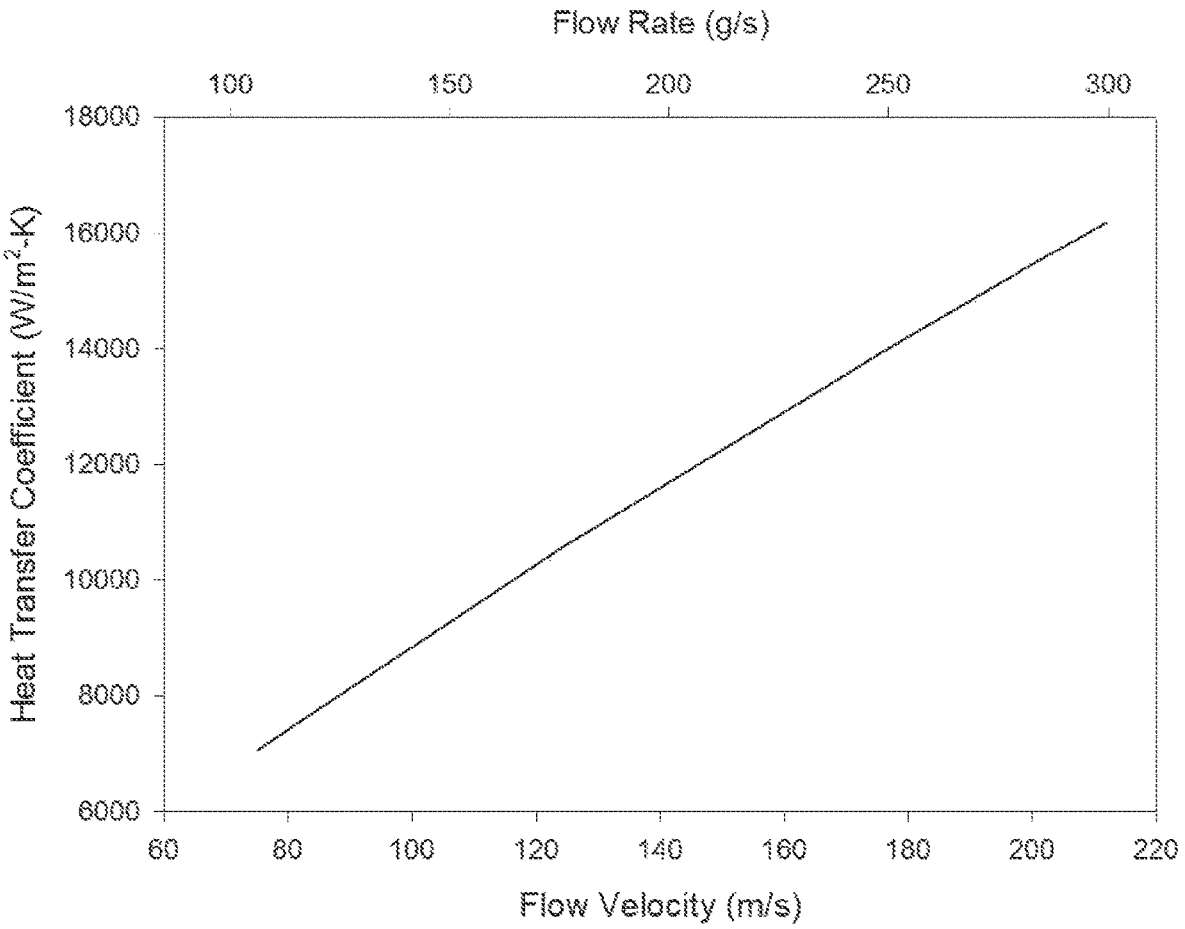
FIG. 3 is a graph of heat transfer coefficient of helium in $W/m^2$-K as a function of flow velocity in m/s, and flow rate in g/s, for an exemplary target channel geometry.

FIG. 2A shows dimensions for an exemplary curved window 20 that was created using the iterative process described above, and FIGS. 2B and 2D show an exemplary apparatus 10 including two exemplary curved window 18. One or both windows 18 are convex into the coolant gas stream. The windows 18 can have a radius of curvature of a sphere (spherical curvature) over at least part, or a majority of, or all of, the window surface facing inward and a different or similar radius of curvature for the concave outer surface. This window shape facilitates cooling the window while reducing thermal stresses. For the example curved window 20 of FIG. 2A, the dimensions are given in inches and also in millimeters which are the bracketed values.

An engineering analysis was performed for an exemplary apparatus similar to the apparatus 10 of FIG. 1B, including 50 Mo-99 disks of 33.2 mm diameter and 0.5 mm thickness that were being cooled with helium. The analysis also included cooling the inner surfaces of the windows 18 while an electron beam suitable for forming radioisotopes was directed at a window of the apparatus such that the beam would penetrate the window and bombard the disks 16 inside the apparatus to form radioisotopes. The beam energy and total beam current for this analysis is 42 MeV and approximately 5.71 microamperes, respectively (2.86 microamperes on each side, which is 120 kW on each side). Heat transfer and hydraulic performance as a function of pressure and flow rate were evaluated, and the thermal-mechanical performance of the beam window was examined.

The target design using 33.2 mm diameter targets was from an initial target optimization and the thermal and fluids analysis was performed with MCNPX (Monte Carlo N-Particle eXtended) heating calculations on this target. Subsequent optimizations incorporating thinner disks resulted in an optimized diameter of 29 mm diameter using 90% dense material and a 12 mm FWHM beam. This target assembly is 82 disks long compared to the 50 disks long target used in the thermal analysis. The heating is low in the middle disks, so the conclusions will be unchanged.

Calculations related to fluid flow were performed on an embodiment that included a subassembly consisting of 50 Mo disks and disk holder. For the calculations, each disk was 0.5 mm in thickness and 33.2 mm in diameter, and each disk was held in the disk holder so that there was a 0.25 mm gap for helium coolant on each face of the disks. For the calculations, the housing that enclosed the subassembly was made from Alloy 718. The target disks and the front and back windows would be attached by welding. The window faces, for the calculation, were curved with spherical geometry and a minimum thickness of 0.25 mm at centerline (see FIG. 2A). The temperature reached and resulting stresses increase with window thickness, so thermal stresses are minimized by thinning the window toward the centerline direction. Mechanical stresses induced by a load are inversely proportional to the window thickness squared, so in this case, stress is reduced by thickening the window. Pressure-induced stress also increases with window diameter squared, so as diameter increases, thickness must also increase.

The shape of the front and back windows was designed to reduce thermal stresses while exposing the inner surfaces of the windows to a maximum coolant flow condition. The disk holder incorporated an upstream bull nose and a downstream diffuser to minimize pressure drop, thereby maximizing helium flow and heat transfer.

During operation, the apparatus will use coolant flow between the target disks, which will establish a parallel flow pattern that will extend from the inner surface of the front window to the inner surface of the back window.

In an embodiment, helium coolant may flow with an inlet mass flow and pressure of 217 gm/s (average 161 m/s through targets, 301 m/s across the windows) and 2.068 MPa. With a Mach number (0.16) less than 0.3, the maximum density variation will be less than 5%; hence, gas that flows with M<0.3 can be treated as incompressible flow. The Mach number across the window in this embodiment is 0.378. Heat transfer coefficient (HTC) were calculated by using flat plate rectangular channel correlations. The hydraulic diameter of the channels will be used to define channel geometry when calculating Reynolds and Nusselt numbers. The classical Colburn equation shown below will be used to define the local Nusselt number $Nu_D$ for fully developed turbulent flow:

$$Nu_D = 0.023 Re_D^{4/5} Pr^{1/3}$$

wherein Pr is the fluid Prandtl number and $Re_D$ is the Reynolds number, which is defined by:

$$Re_D = \frac{\rho \cdot v \cdot D_h}{\mu}.$$

In the above equation, υ is the mean fluid velocity over the cross section of the channel, $D_h(4A_c/P)$ is the hydraulic diameter, ρ is the fluid density, and μ is the viscosity. The heat transfer coefficient is then defined according to the equation:

$$h = Nu_D \frac{k}{D_h}.$$

In the above equation, k is defined as the coolant's thermal conductivity.

In an embodiment using a mean velocity of coolant through the target channel of 161 m/s at 217 g/s and inlet pressure of 2.068 MPa, the heat transfer coefficient (HTC) would be 12990 $W/m^2$-K. If the mean velocity of coolant were increased by 15% to 185 m/s, then the HTC would increase by approximately 11.7%. Embodiments include molybdenum target disks and INCONEL Alloy 718 windows. Molybdenum target disk and INCONEL Alloy 718 window heat loads to the helium are listed in Table 1. Thermal hydraulic flow conditions for the helium coolant are listed in Table 2. Table 3 lists helium properties at 293K. It may be noted that the bulk mean temperature of the helium at this flow rate and power is about 130° C.

TABLE 1

| Electron beam heat loads at 42 MeV and 5.71 mA | |
|---|---|
| Target disks | 151 kW |
| Front Face | 1.296 kW |
| Back Face | 1.296 kW |
| Total | 153 kW |

TABLE 2

| Estimated Thermal hydraulic flow conditions. | |
|---|---|
| Channel Geometry | 32.7 mm × 0.25 mm |
| Flow rate per channel | 1.316 L/s |
| Channel Velocity | 161 m/s |
| Inlet Velocity | Approximately 50 m/s |
| Mach Number | 0.16 |
| Reynolds Number | 13800 |
| Nusselt Number | 41.623 |
| Heat Transfer Coefficient | 12990 $W/m^2K$ |

TABLE 3

| Properties of Helium at 293 K | |
|---|---|
| Density | 3.399 kg/m3 |
| Thermal Conductivity | 0.15488 W/m-K |
| Specific Heat | 5.1916 J/g-K |
| Viscosity | $1.9583 \times 10^{-5}$ Pa-s |
| Pr | 0.66 |

Figure 4:
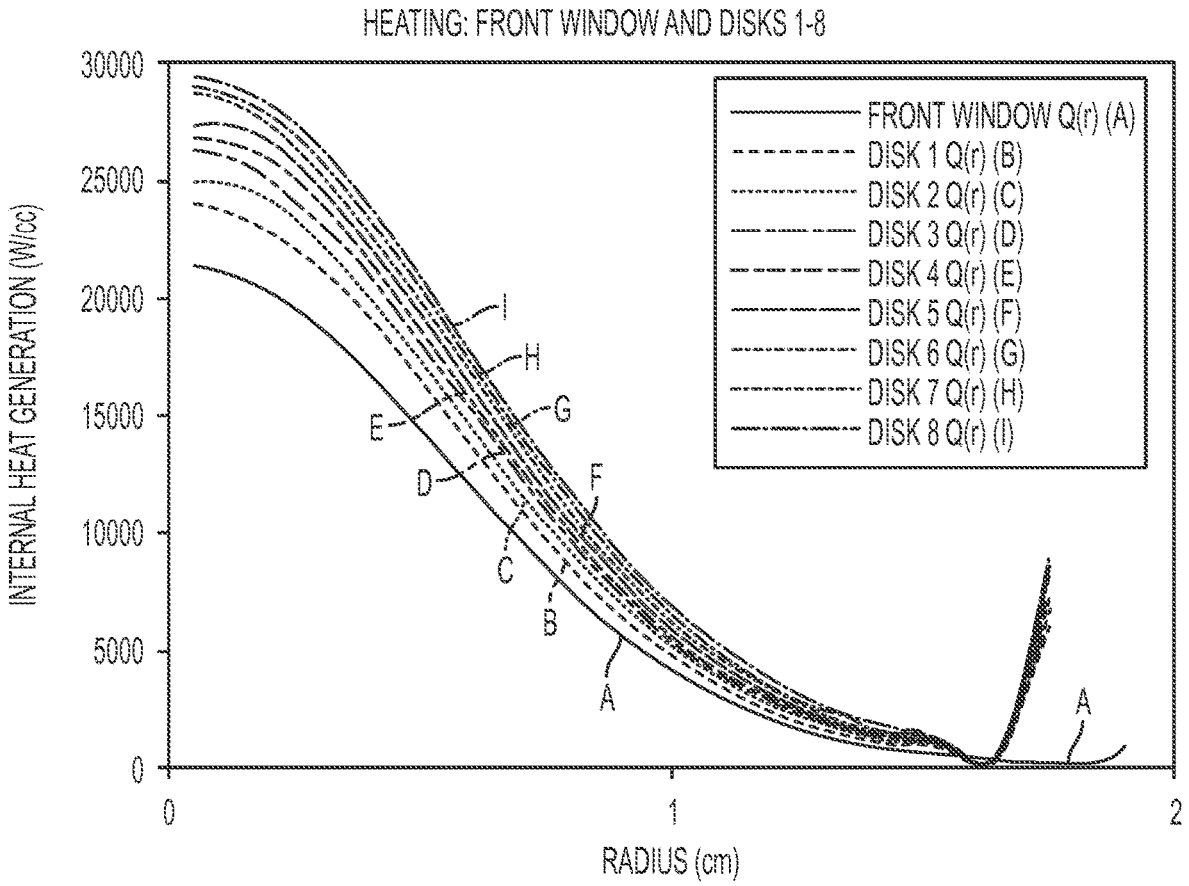
FIG. 4 shows a graph of internal heat generation (W/cc) as a function of radius (cm) for heating a front window and target disks 1 through 8 in an exemplary apparatus. The lowest curve provides data plotted for the window, the next lowest curve provides data plotted for disk 1 (the disk closest to the window), the next lowest curve provides data plotted for disk 2, and so on, to the topmost curve which provides plotted data for disk 8.

Numerical analysis input for internal heat generation was done as a function of disk radius as shown in FIG. 4.

Conjugate Heat Transfer Analysis

Figure 5:
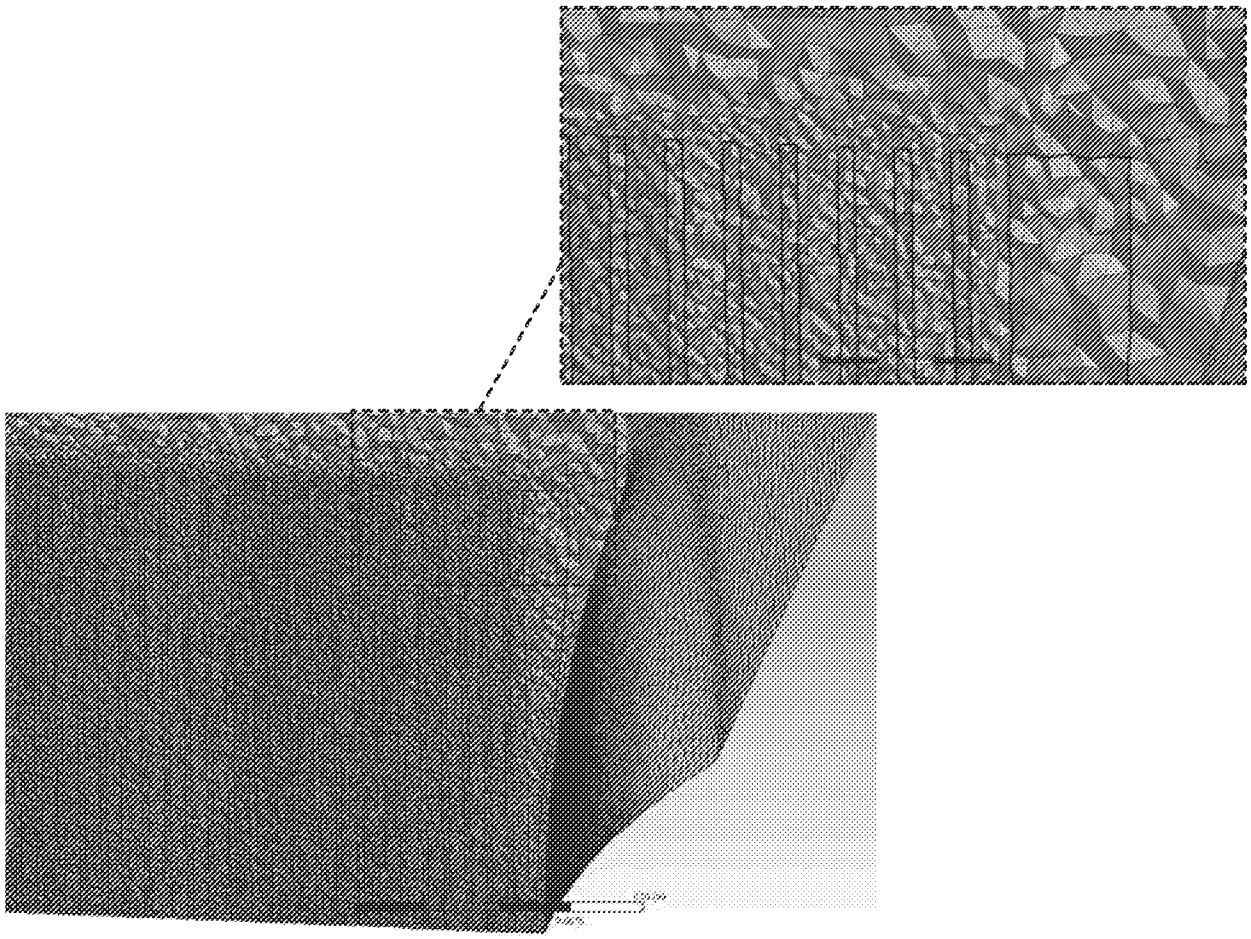
FIG. 5 shows a conjugate heat transfer mesh for a computational fluid dynamics calculation.

Computation fluid dynamic (CFD) techniques were used to solve the steady state conjugate heat transfer problem using ANSYS CFX (v. 14.5.7). A configuration of 50 molybdenum target plates allows for parallel coolant flow through 51 rectangular passages. The boundary conditions used in the analysis were as follows: assuming fixed available head dependent only on a selected blower, the pressure drop of 0.103 MPa (15 psi) across the targets was used. Therefore, a total pressure of 2.069 MPa (300 psi) at the inlet and static pressure of 1.965 MPa (285 psi) at the outlet with the system mass flow was part of the solution. Each channel has a nominal rectangular cross section 0.25 mm (0.0098 in) wide by 32.7 mm (1.287 in) high. A sample of the mesh is shown in FIG. 5. The molybdenum target assembly was meshed using approximately 19.6 million nodes. To reduce computational efforts in the problem, symmetry was used in XY and XZ planes. Flow field and geometry are symmetric, with zero normal velocity at symmetry plane and zero normal gradients of all variables at symmetry plane.

Figure 6:
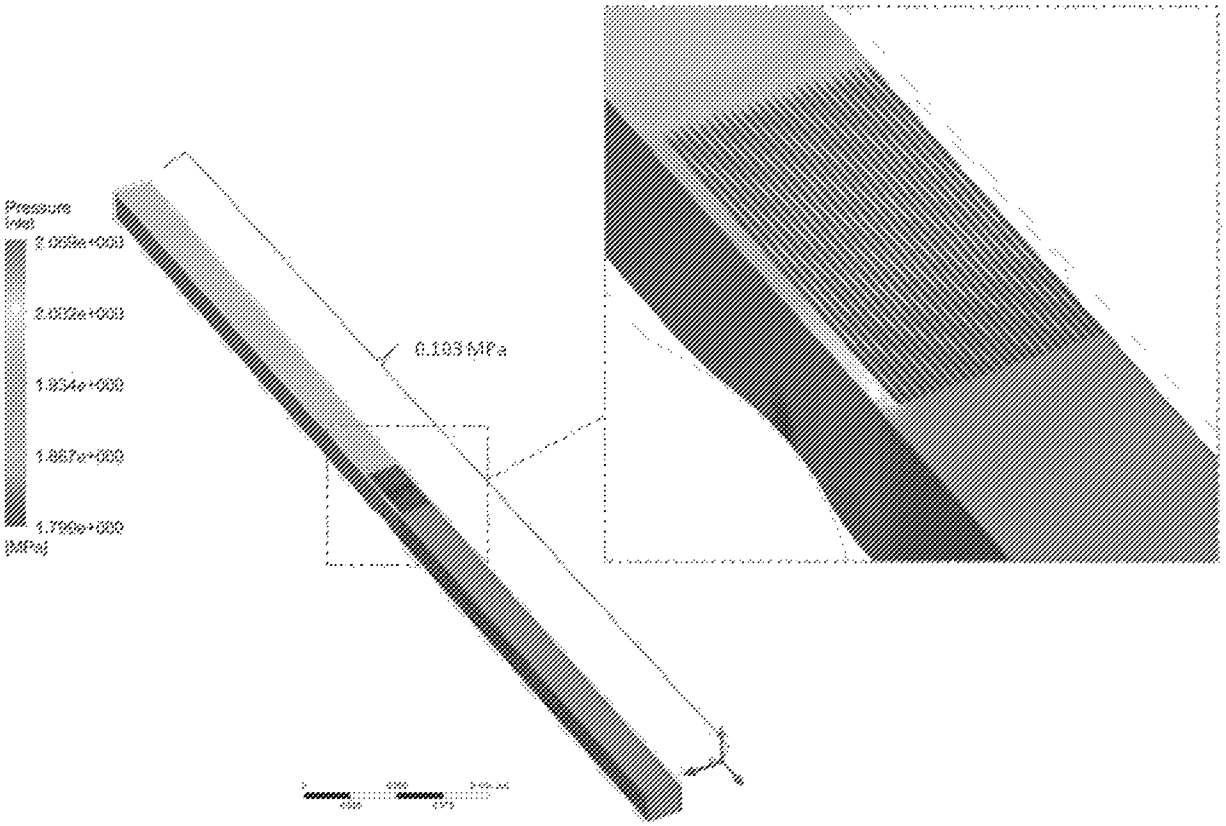
FIG. 6 shows pressure contour for helium coolant.
Figure 7:
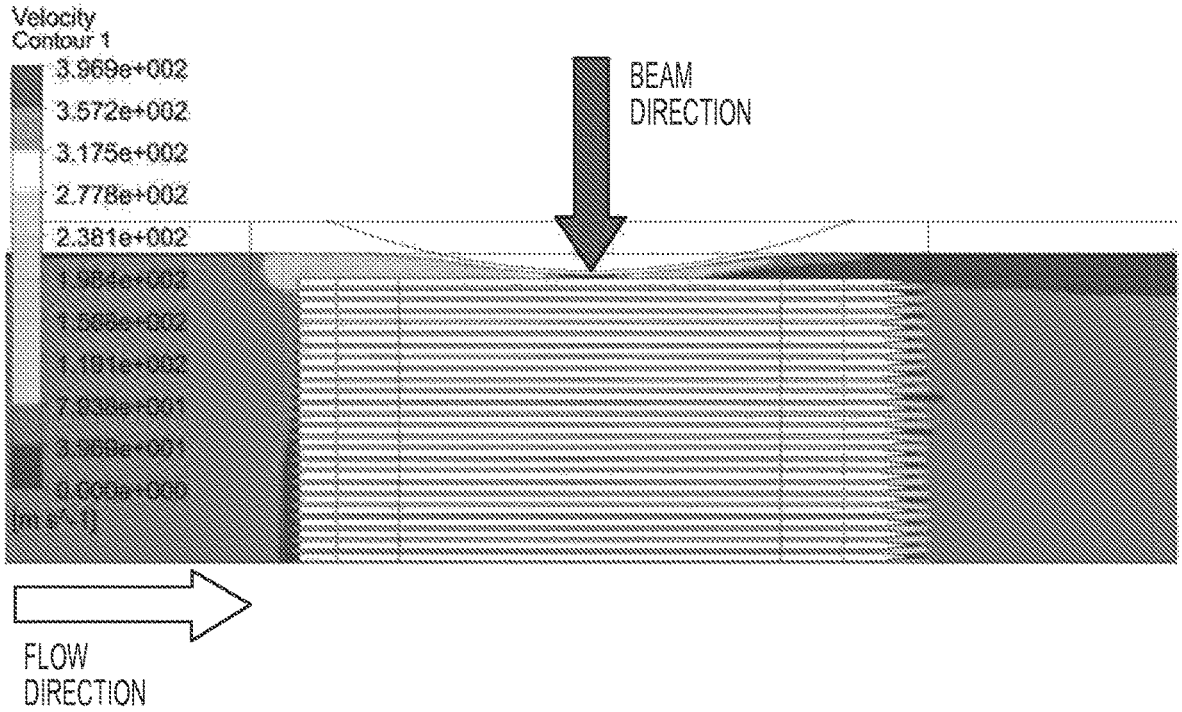
FIG. 7 shows a velocity contour plot in the XZ plane; as the plot shows, the beam direction is in the plane of the figure at the midpoint of the window, and the coolant velocity is slowest before reaching the edges of the targets and fastest for coolant flowing in between the window and the first target, with a coolant flow velocity increasing as the coolant approaches the plane of minimum distance between the window and the first target, where the flow reaches maximum velocity, and afterward the coolant velocity decreases.
Figure 8:
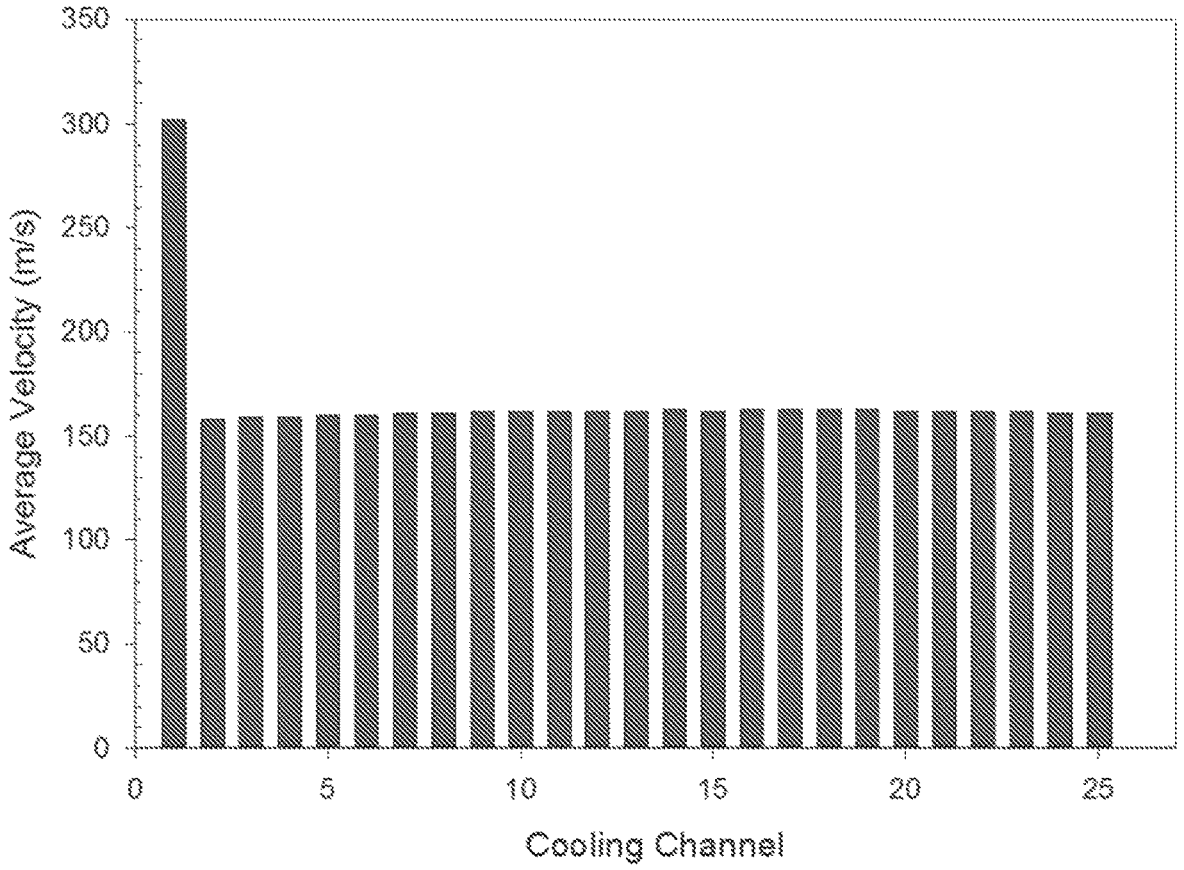
FIG. 8 shows a plot of cooling channel average velocity; the velocity is highest for the first cooling channel, and is approximately the same for the next 24 cooling channels.
Figure 9:
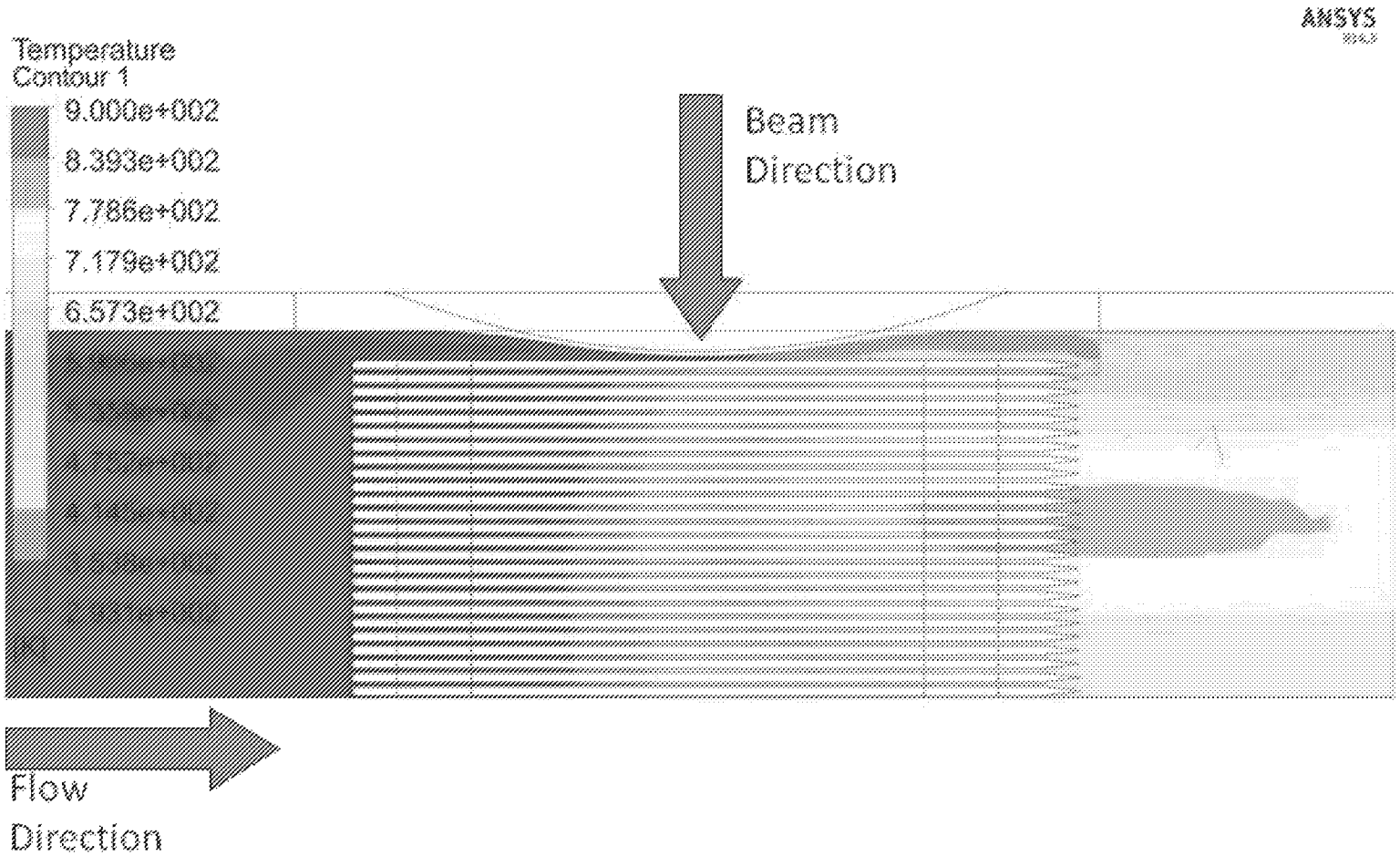
FIG. 9 shows a plot of gas temperature from 293.15 K to 900 K.

Results of the molybdenum target CFD analysis are shown in FIGS. 6-9. FIG. 6 shows relative surface pressure contours. FIG. 7 shows the velocity contours through the cooling channels from the XZ plane view. FIG. 8 shows a bar graph of the average velocity in the cooling channels at a specific location which is defined as a plane parallel to beam center. FIG. 9 illustrates the coolant helium gas temperature range 293.15K to 900K.

Figure 10:
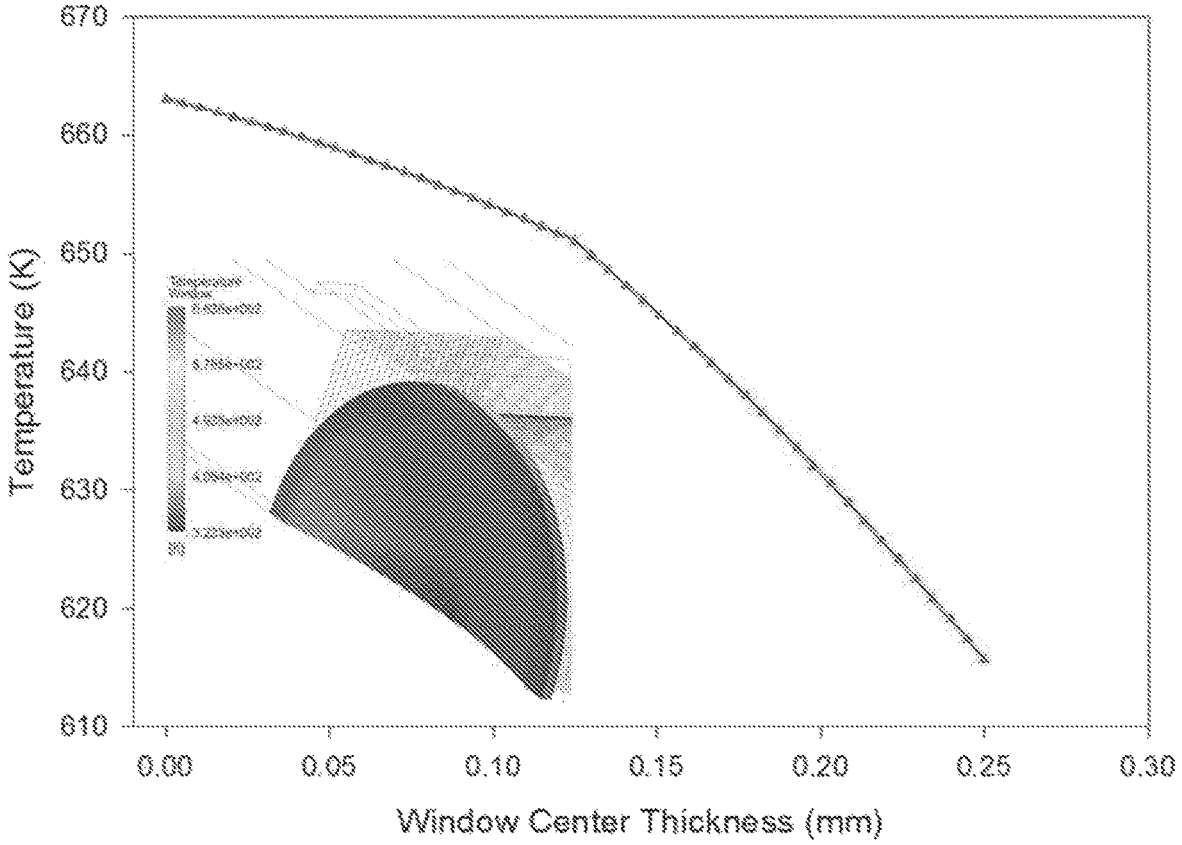
FIG. 10 shows a temperature profile through center thickness of the Alloy 718 window. Temperature contour plot of front window is shown in the insert.
Figure 11:
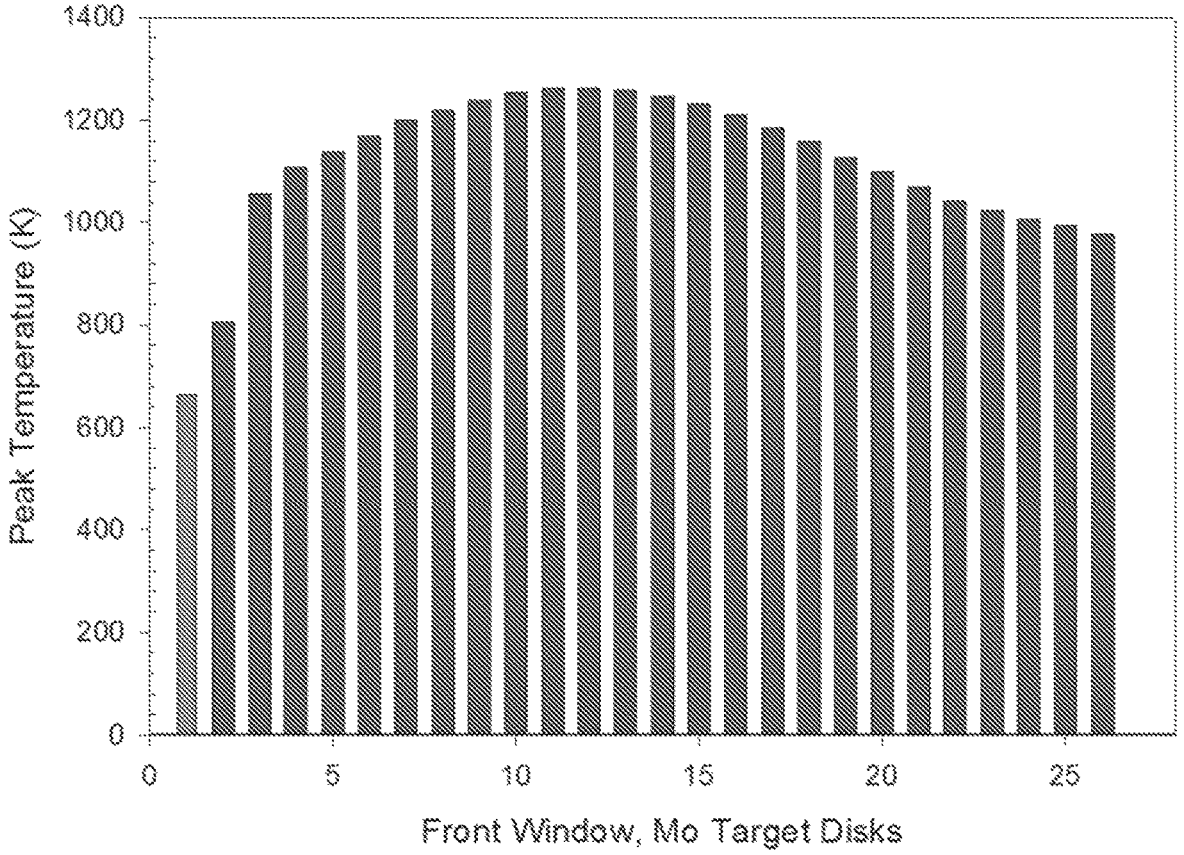
FIG. 11 shows a plot of peak temperatures of the front window and of first 25 of the 50 molybdenum target disks.

Plots of steady state temperature for the assembly and target disks at a beam energy and current of 42 MeV and approximately 5.71 microamperes (μA) were prepared. The peak temperature in the Alloy 718 window is calculated at approximately 663.6 K for both the front and rear windows. FIG. 10 illustrates the temperature profile through the front window center thickness. Peak target disk temperature occurs in target disk 10 with peak temperature of 1263° K. The bar graph in FIG. 11 shows peak temperatures in 25 of the 50 target disks (symmetric beat deposition) plus the front window.

Figure 12:
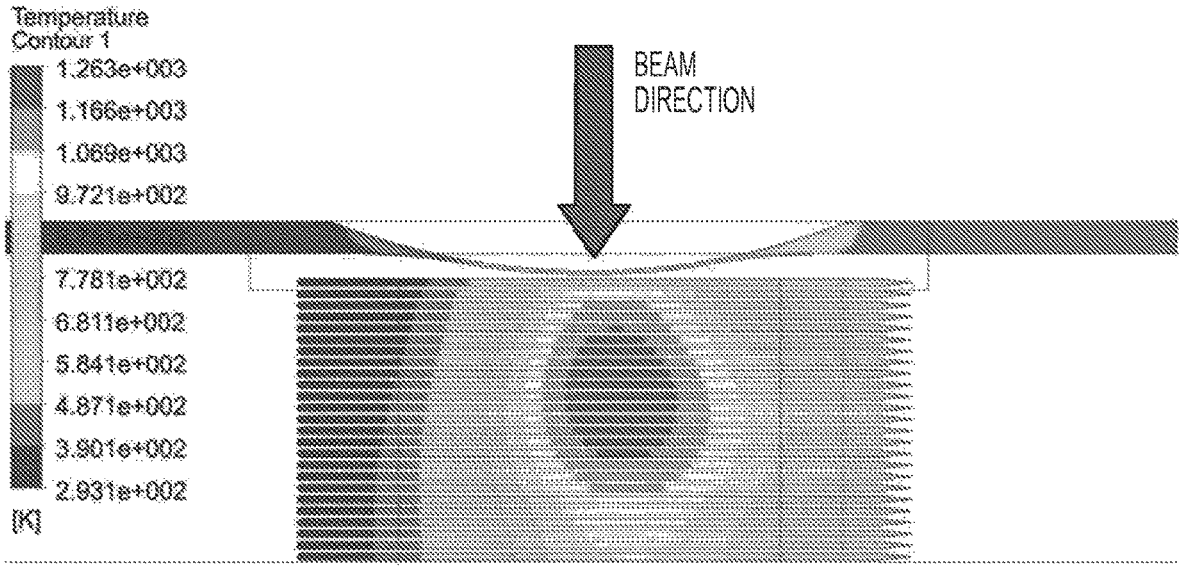
FIG. 12 illustrates the temperature contour plot of the target assembly (i.e. housing and target disks) from the XZ plane view at beam energy of 42 MeV and current 5.71 milliamperes.

FIG. 12 illustrates the temperature contour plot of the housing and target disks from the XZ plane view.

Static Stress Analysis on Alloy 718 Housing

FE stress analysis was performed using ASME B&PV code Section VIII, Part 5, which outlines requirements for application of design-by-analysis methodology. Section II, Part D Mandatory Appendix I was used for determining the allowable stress value.

The application of the design-by-analysis methodology requires verification of component adequacy against the following five specific failure modes:

1. All pressure vessels provided with protection against overpressure.
2. Protection against plastic collapse:
   Elastic stress analysis method.
   Design allowable stress, Sm: Sm=lesser of $2/3\sigma_y$ or $\sigma_{ult}/3.5$.
   Primary membrane plus bending stress: Pm+Pb≤1.5Sm
   Elastic-plastic stress analysis method.
   True stress-strain curve.
   Include effects of non-linear geometry.
3. Protection against local failure:
   The sum of the local primary membrane plus bending principal stresses:

$$(\sigma 1+\sigma 2+\sigma 3)\leq 4Sm$$

4. Protection against buckling:
   None. No external loading conditions.
5. Protection against failure from cyclic loading:
   None.

The relevant loads acting on the Alloy 718 window and load definitions are shown in FIG. 13. FIG. 14 illustrates the stress categories and limits of equivalent stress (Von Mises Yield criterion).

Figure 15:
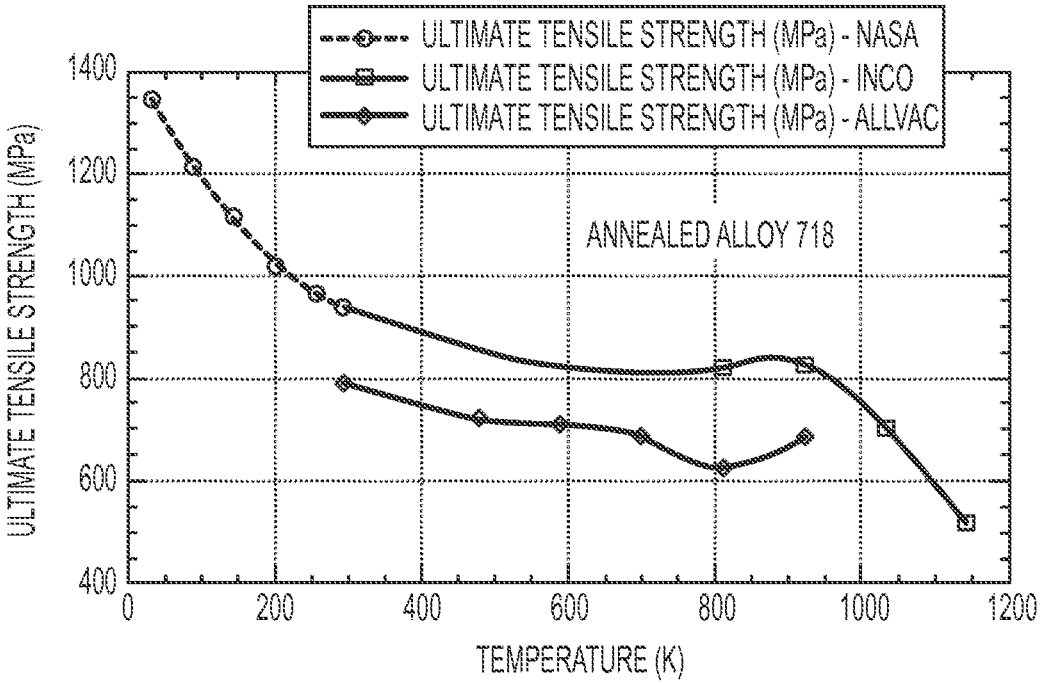
FIG. 15 is a graph of effect of test temperature on the UTS of annealed 718 Alloy.
Figure 16:
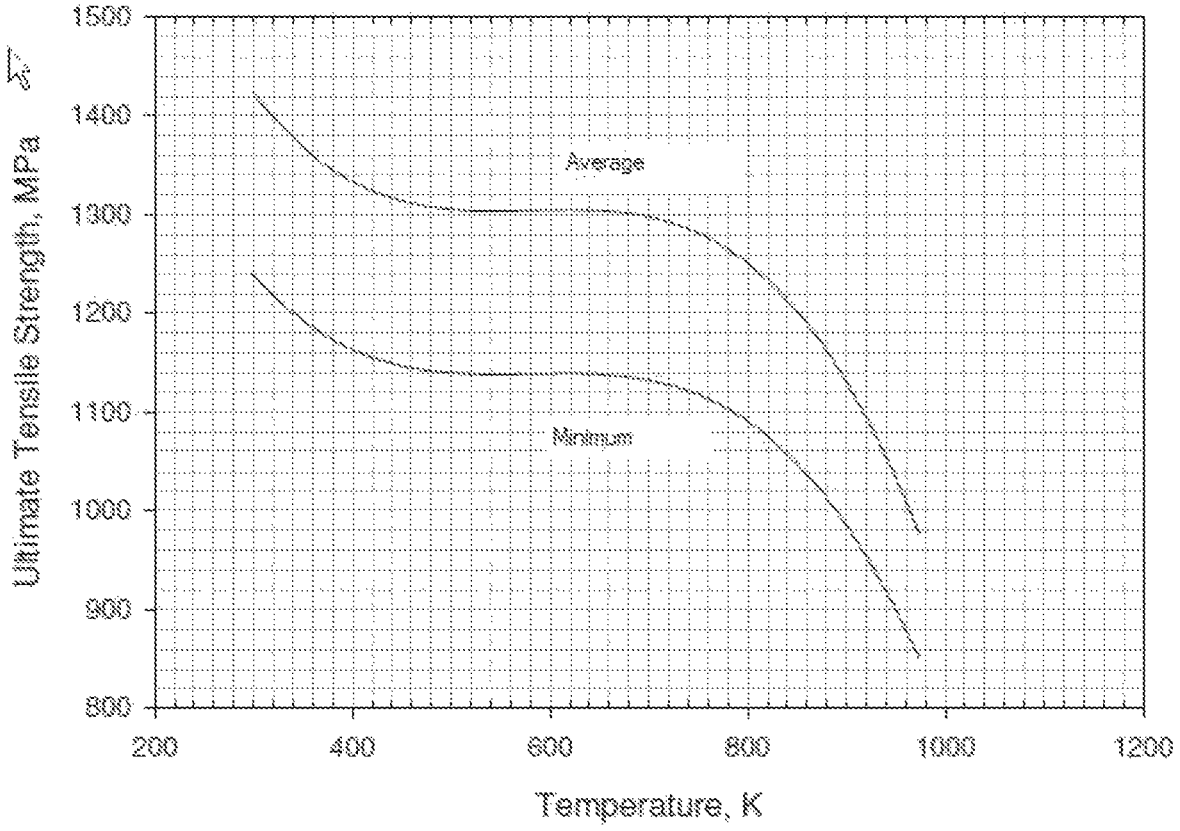
FIG. 16 is a graph of UTS of precipitation hardened INCONEL Alloy 718 as a function of temperature.

The housing is pressure loaded at up to 2.068 MPa (300 psi), and held with a fixed restrained at the upstream, while the downstream is free in the axial direction. Ultimate tensile strength values of annealed Alloy 718 range from 687 MPa to 810 MPa, which yields an allowable stress ranging from 196 MPa to 231 MPa. Values of UTS as a function of test temperature are plotted in FIG. 15. The strength properties of precipitation-hardened (PH) alloy is significantly higher than that for the annealed material. The minimum expected UTS at 700 K is 1133 MPa roughly 40% increase in strength over the annealed alloy. Average and minimum values of ultimate tensile strength appears in FIG. 16.

Load Combination: $P+P_s+D$

Figure 17:
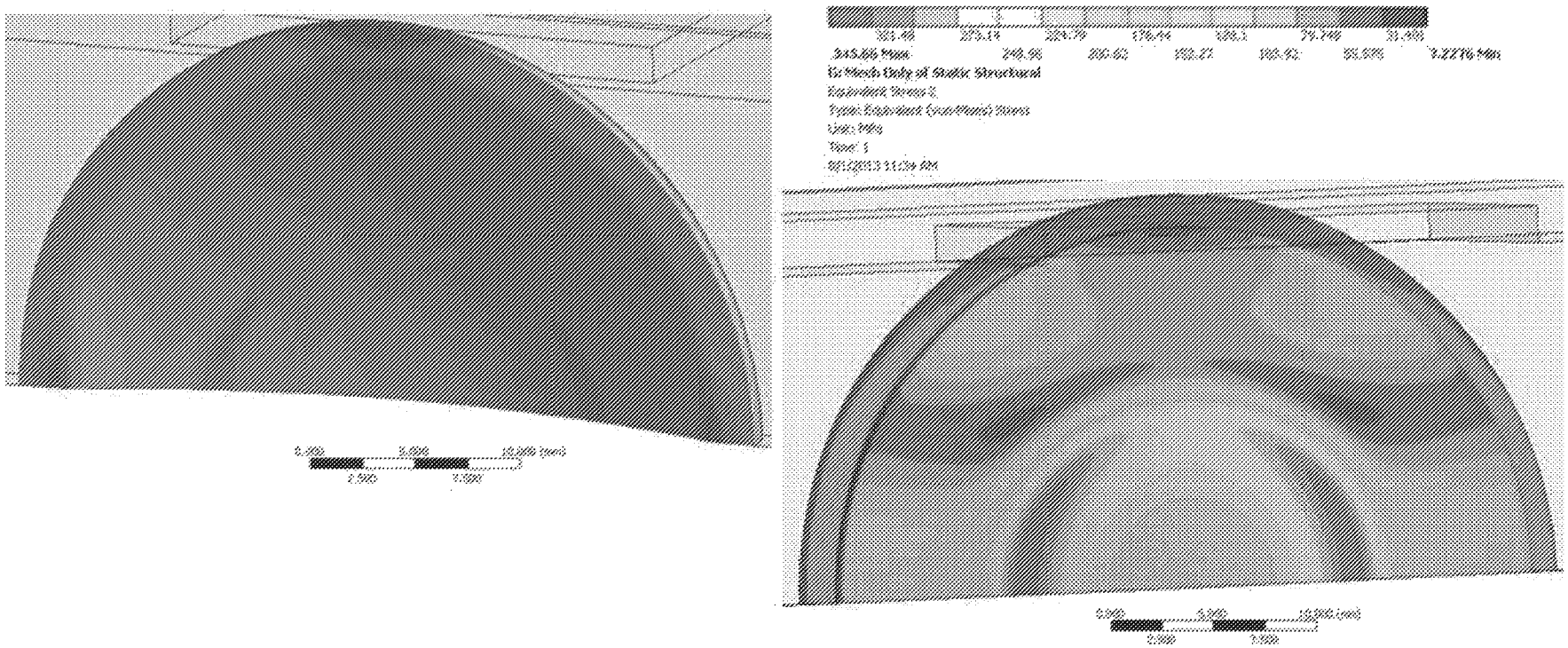
FIG. 17 shows a von Mises stress plot (i.e., a stress contour plot) of an Alloy 718 window with only the applied mechanical loads (300 psi pressure).
Figure 18B:
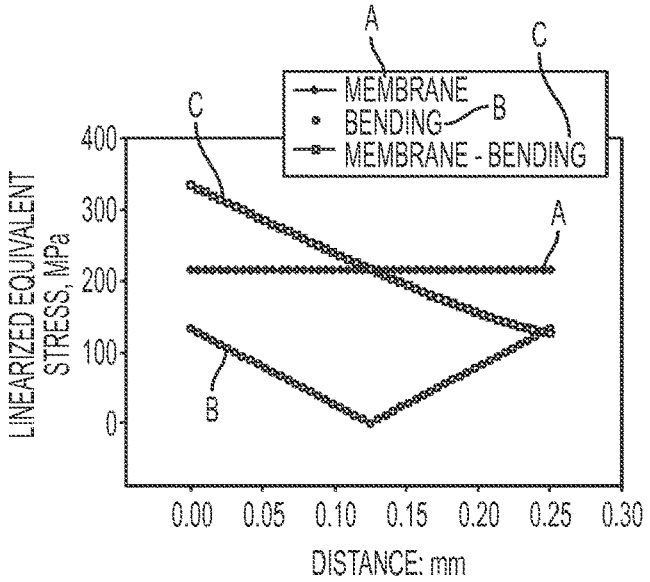
FIGS. 18A-18C shows the linearized stresses (membrane, bending, and membrane plus bending) at two different locations.
Figure 18A:
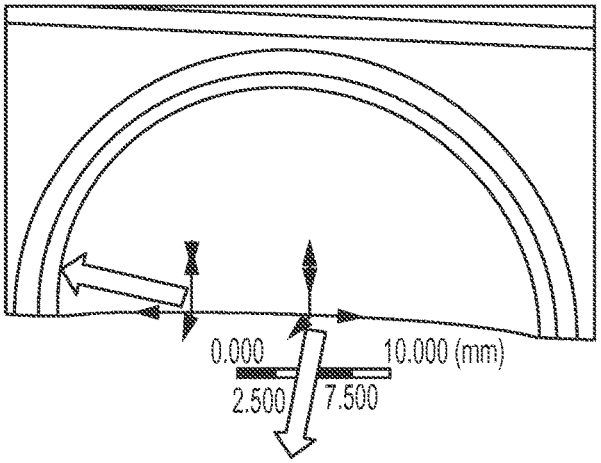
Figure 18C:
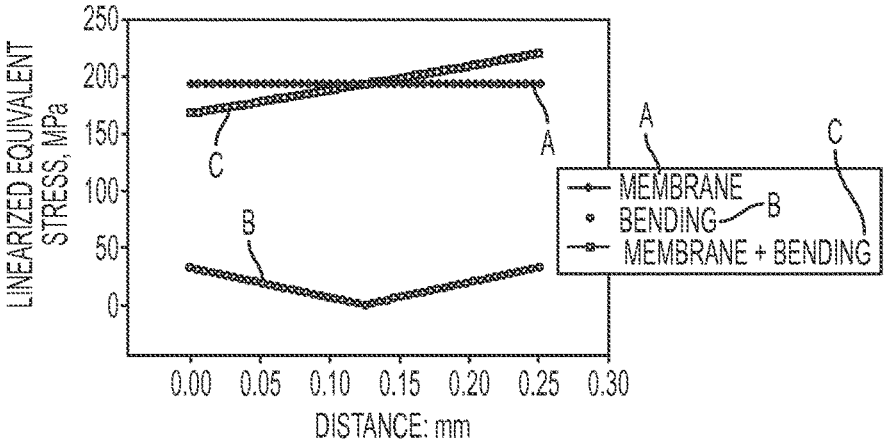
Figure 19:
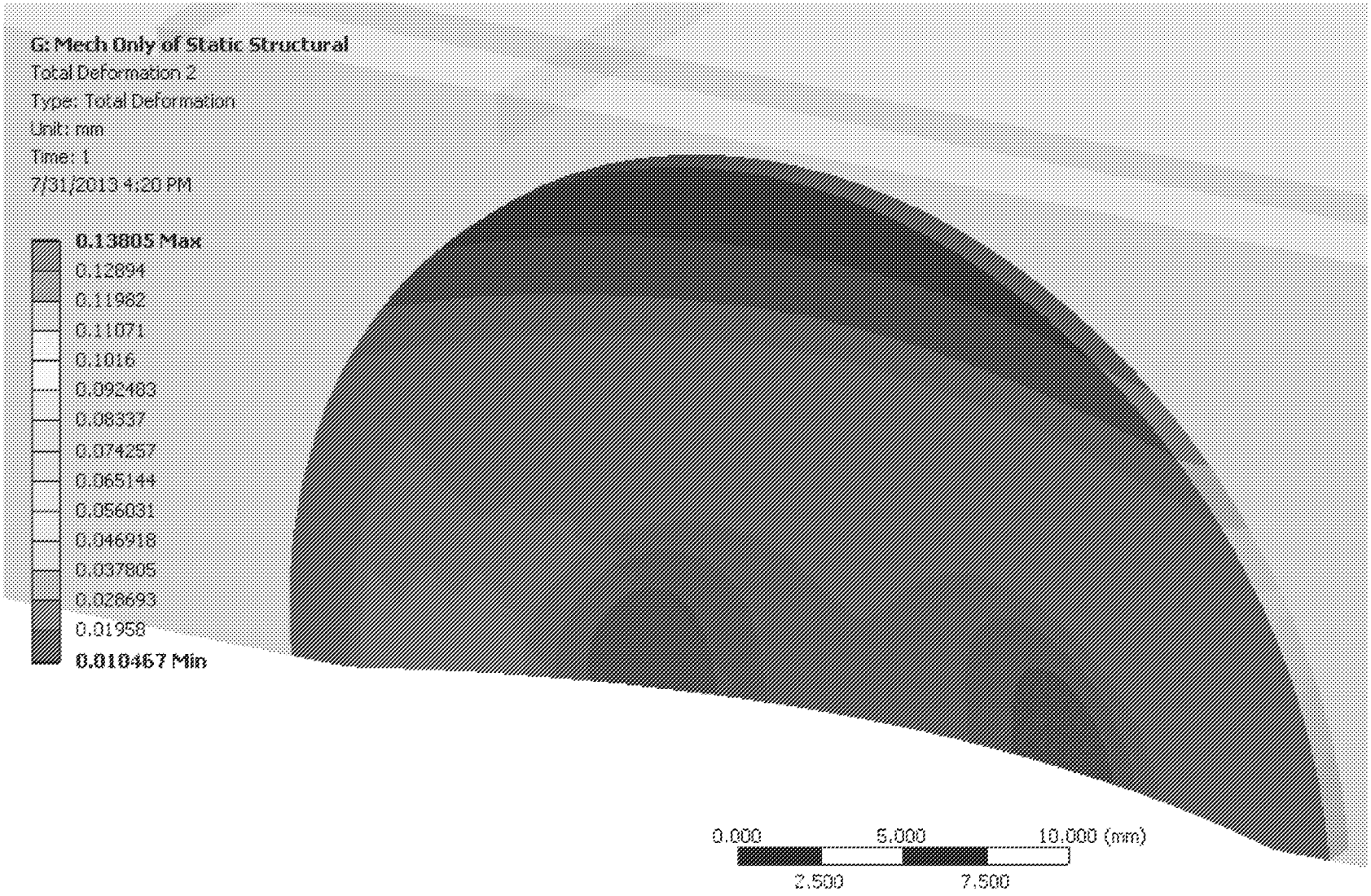
FIG. 19 shows a plot of deformation of a window.

The stress linearization finds the distribution of stress through the thickness of thin-walled parts to relate 3-D solid finite element analysis (FEA) models of pressure vessels to the ASME BPVC. FIG. 17 shows a von Mises stress plot of the Alloy 718 window with only the applied mechanical loads. FIGS. 18B and 18C show the linearized stresses (membrane, bending, and membrane plus bending) at two different locations shown in FIG. 18A. Taking a conservative approach and using the allowable stress values at 811 K (234 MPa), it is shown in FIGS. 18A-18C that the membranes stress that are plotted for both locations are below the allowable threshold of 234 MPa. Moreover, when looking at primary membrane plus bending stress, Pm+Pb≤1.5Sm, this too is below the 1.5Sm limit (351 MPa). FEA results show a peak deformation of 0.138 mm in the window (see FIG. 19).

Load Combination

Figure 20:
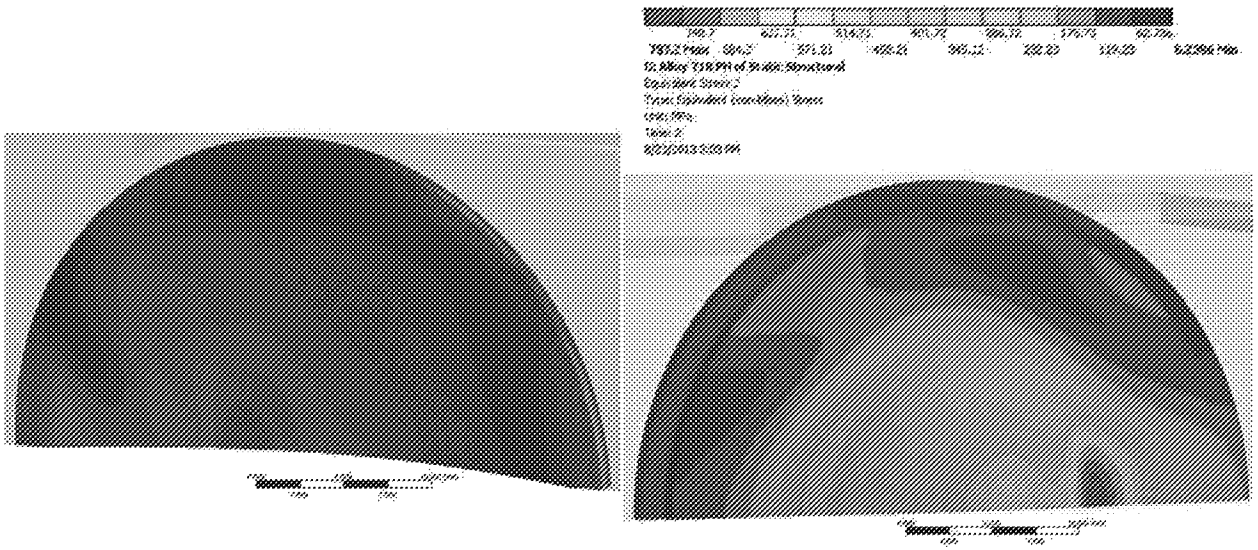
FIG. 20 shows thermal stress results of the window results obtained by coupling the CFD model results to the FE model with the mechanical loads.
Figure 21:
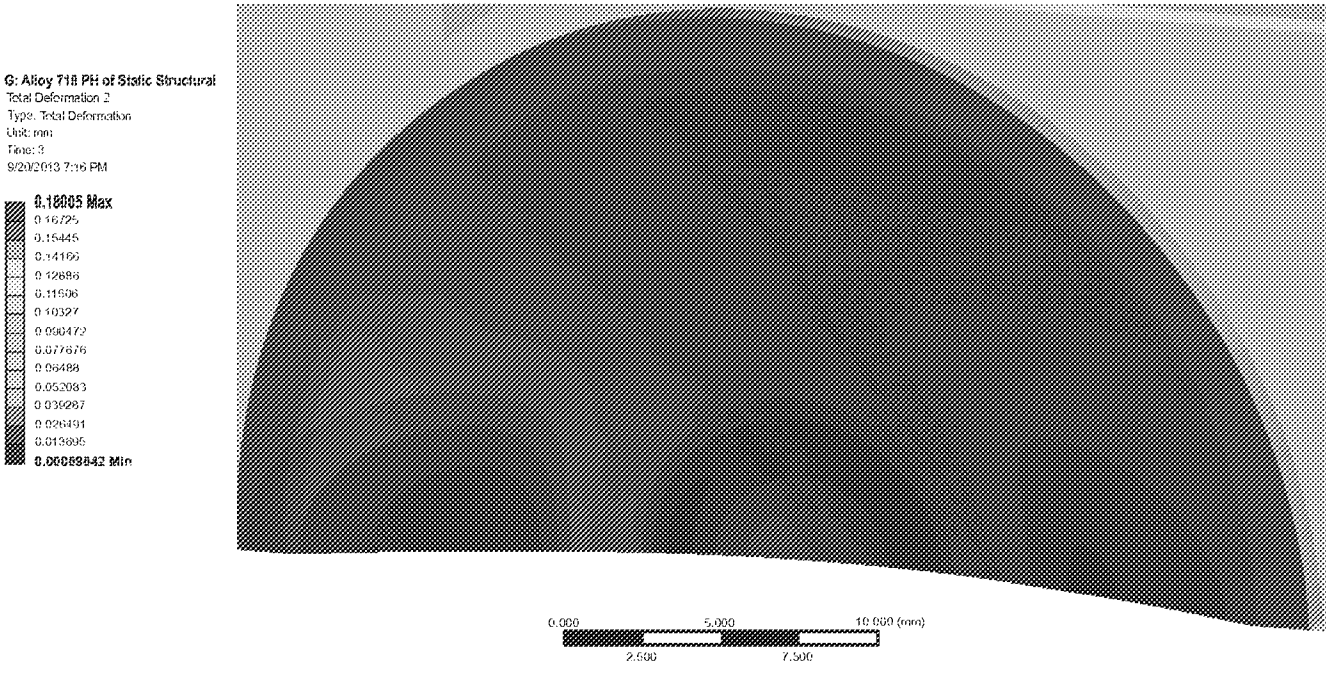
FIG. 21 shows thermal and mechanical loading on the window, which produced a peak deformation of 0.180 mm; the deformations are not located at the peak of the window and therefore are not expected to impact the coolant gap width and the coolant flow characteristics.

By coupling the CFD model results to the FE model with the mechanical loads, the thermal stress results of the window are depicted in FIG. 20. The addition of the thermal expansion has increased the von Mises stress by approximately 2.33×, hence these secondary stress components are the dominating term. Thermal and mechanical loading on the window produced a peak deformation of 0.180 mm, shown in FIG. 21. The deformations are not located at the peak of the window and therefore are not expected to impact the coolant gap width and the coolant flow characteristics.

Figure 22:
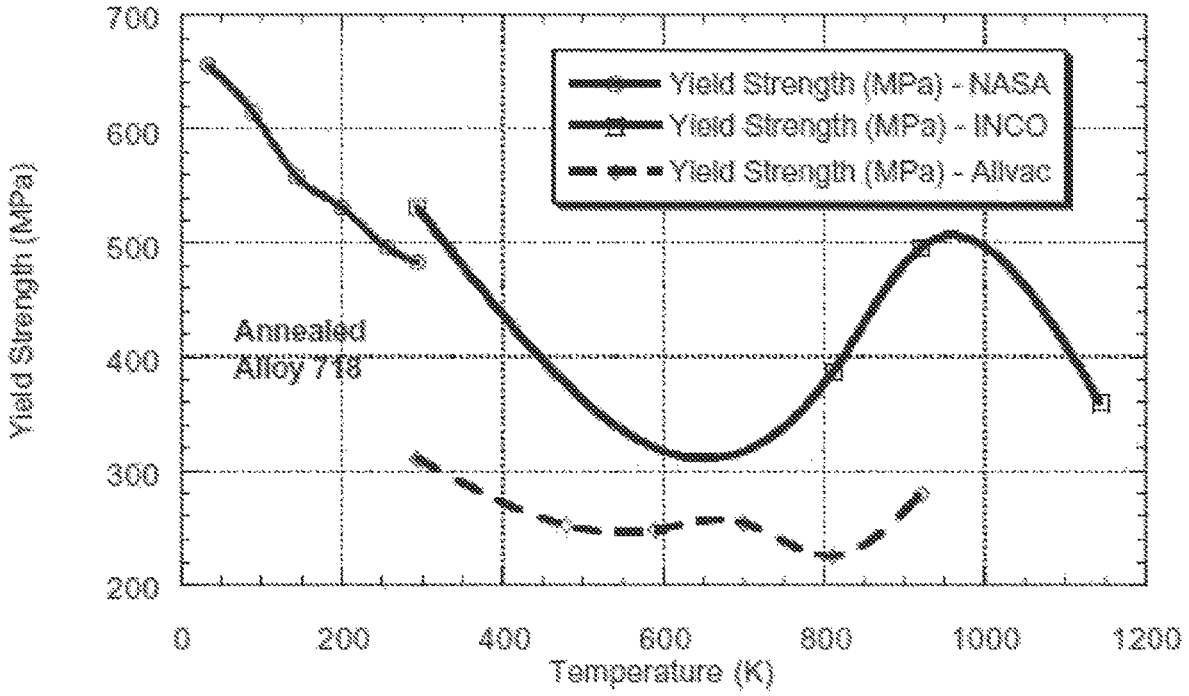
FIG. 22 is a graph showing the effect of test temperature on the yield strength of annealed INCONEL alloy 718.
Figure 23:
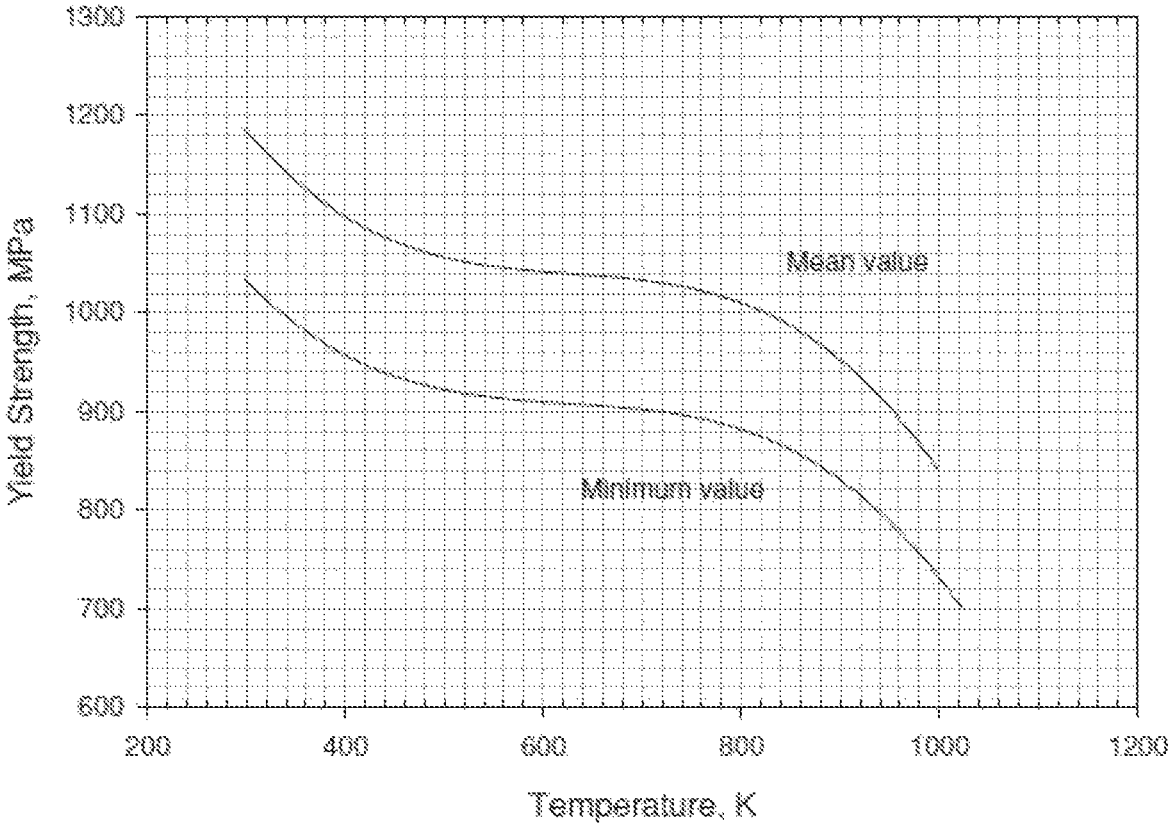
FIG. 23 shows the yield strength of precipitation hardened INCONEL Alloy 718 as a function of temperature.
Figure 24A:
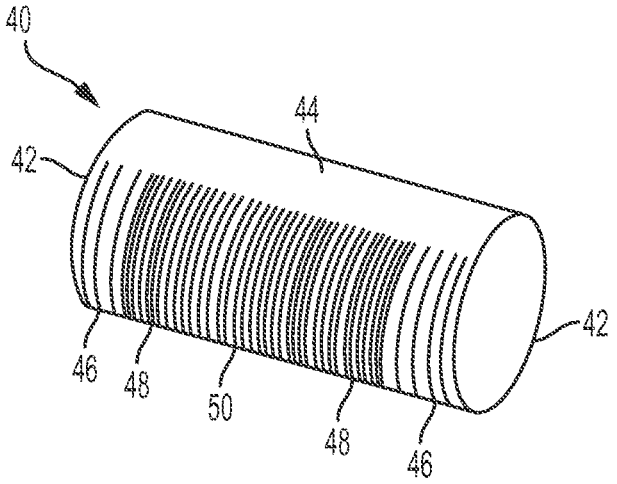
FIG. 24A is an isometric view of an exemplary target having a generally cylindrical shape with cross-channels.
Figure 24B:
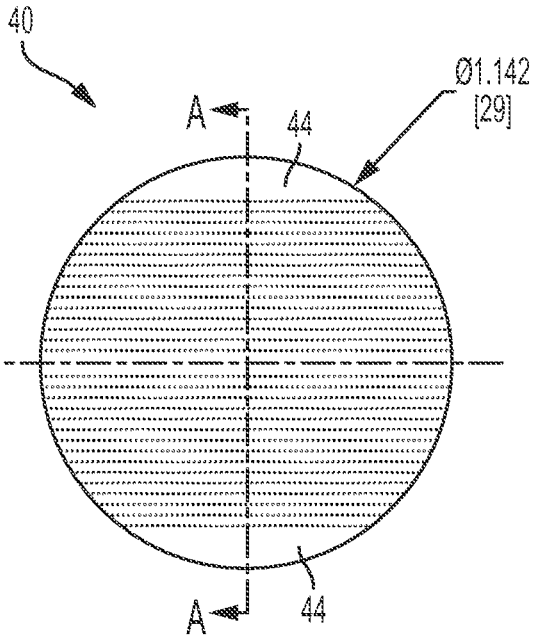
FIG. 24B is a cross-sectional view of the target of FIG. 24A taken perpendicular to the longitudinal axis of the cylindrical shape in the middle of the target.
Figure 24D:
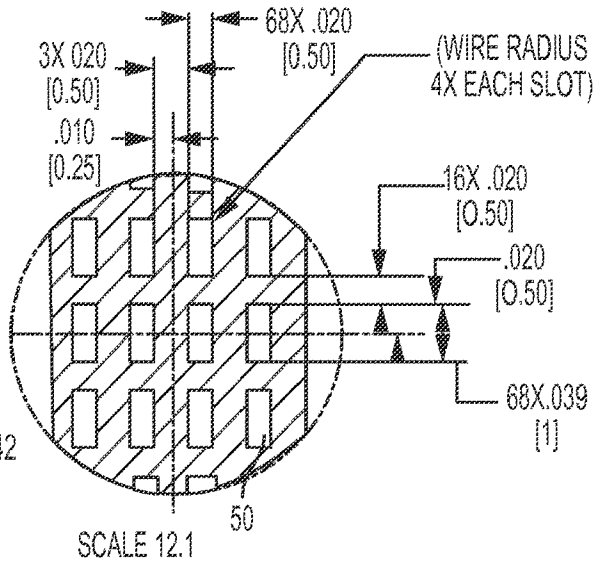
FIG. 24D is an enlarged view of a portion of FIG. 24C.
Figure 24C:
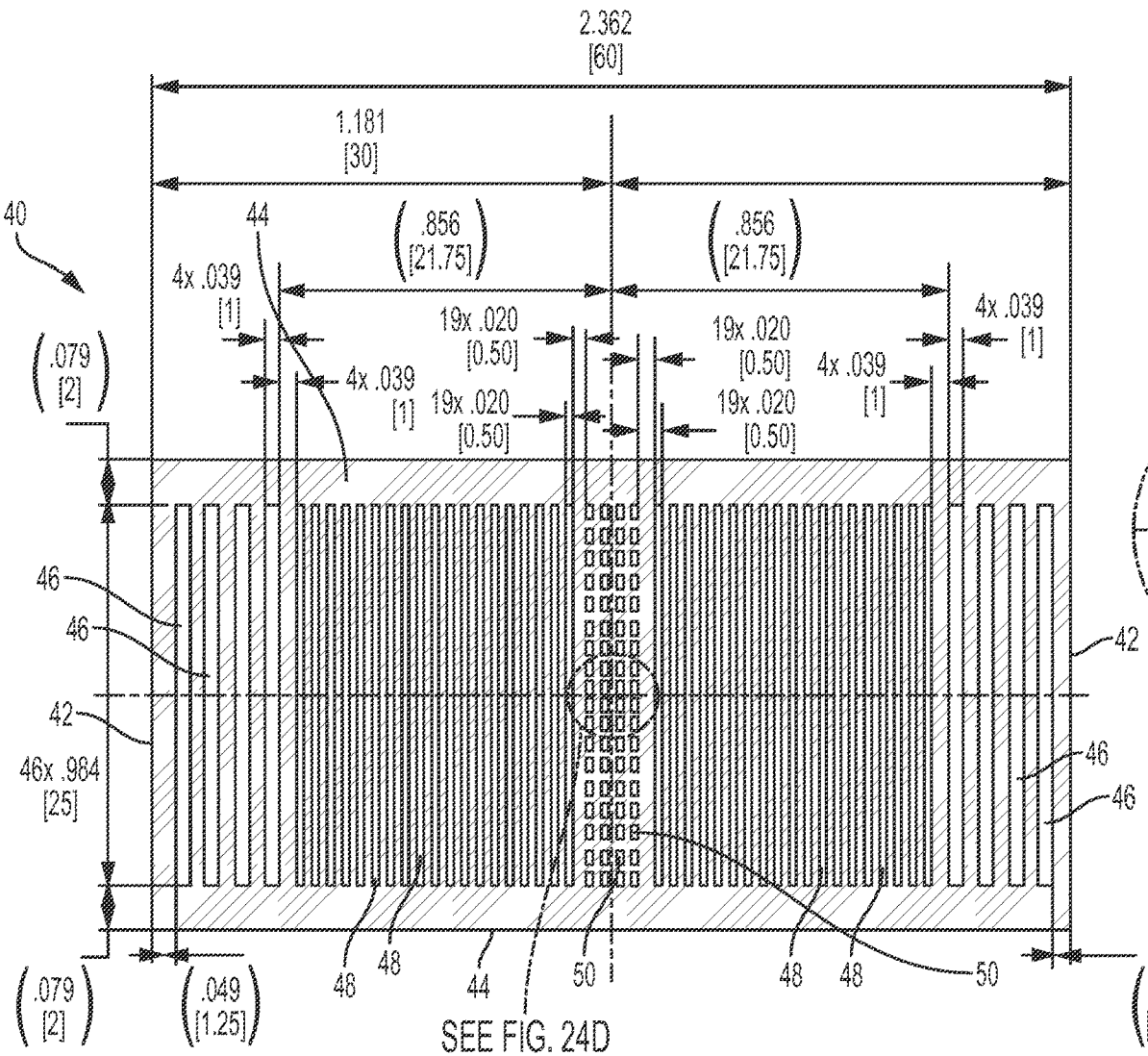
FIG. 24C is a cross-sectional view of the target of FIG. 24A taken along the longitudinal axis.

The yield strength of annealed alloy 718 at 700 K translates to values of 320 MPa according to the INCO curve on FIG. 22 and 254 MPa on the ALLVAC curve also in FIG. 22. However, PH alloy 718 has a yield strength of 917.7 MPa at 700 K, which is roughly a factor of 3.6× higher than annealed ALLVAC value and 2.85× higher than the INCO value. Average and minimum values of yield strength appears in FIG. 23 over the temperature range 294 K to 1020 K for PH alloy 718.

The elastic-plastic analysis has predicted that at the current operating pressure of 2.068 MPa the stress value of 797.2 MPa is below the yield strength (but near the materials proportionality limit) of PH alloy 718 at 700 K as it is shown in FIG. 20. Also shown in the analysis potentially critical plastic collapse occurs in a pressure greater than 3.1026 MPa (450 psi). The same cannot be said for annealed alloy 718: the simulation revealed that at the current operating pressure of 2.068, the peak stress has exceeded the materials yield strength at 700 K. In addition, plastic collapse occurs with a pressure of 1.0342 MPa (150 psi). This would yield an operating pressure significantly lower than the current 2.068 MPa (300 psi). The table below simplifies and summarizes the stress results described above.

TABLE 4

Stress results vs. alloy treatment

| Material | Analysis method: Elastic stress P + Ps + D, MPa | Analysis method: Elastic plastic stress 2.1(P + Ps + D + T), MPa | $UTS_{MIN}$ @ 700 K | Y.S.MIN @ 700 K |
|---|---|---|---|---|
| Annealed INCONEL alloy 718 | 345.66 | 362.15 @ 2.169 MPa internal pressure | 687 | 254 |
| Precipitation-hardened INCONEL alloy 718 | 345.66 | 797 @ 2.168 MPa internal pressure | 1133 | 917 |

Stress in the precipitation hardened INCONEL alloy 718 window is behaving within the typical true elastic limit, with stress proportional to strain. However, the annealed window will deform plastically and the strain will increase faster than the stress. It is that when the window in plastically deformed strain hardening will occur. This is due to the dislocation generation and movement within the crystal structure of the material.

In summary, an apparatus useful for isotope production includes a pair of windows convex to the interior and are expected to be superior compared to flat windows for coolant pressure and beam heating stresses. Analysis has shown that in order to operate at 2.068 MPa, a precipitation hardened window material such as precipitation hardened INCONEL alloy 718 is more robust than the corresponding annealed alloy. The apparatus provides a solution to high power, high flux targets needed for optimal production of radioisotopes such as molybdenum-99 from molybdenum-100 targets.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Integers, characteristics, materials, and other features described in conjunction with a particular aspect, embodiment, or example of the disclosed technology are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods.

As used herein, the terms "a", "an", and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A", "B,", "C", "A and B", "A and C", "B and C", or "A, B, and C." As used herein, the term "coupled" generally means physically coupled or linked and does not exclude the presence of intermediate elements between the coupled items absent specific contrary language.

In view of the many possible embodiments to which the principles of the disclosed technology may be applied, it should be recognized that the illustrated embodiments are only examples and should not be taken as limiting the scope of the disclosure. Rather, the scope of the disclosure is at least as broad as the following claims. We therefore claim all that comes within the scope of the following claims.

The invention claimed is:

1. An apparatus for radioisotope production comprising:

a housing;

a target holder positioned inside the housing and configured to hold one or more targets in the housing for radioisotope production;

at least one curved window coupled to the housing and positioned adjacent to the target holder, the at least one curved window having a convex curved surface oriented facing into the housing toward the target holder, the at least one curved window operable to transmit radiation from outside the housing into the target holder for irradiation of one or more targets held by the target holder within the housing to produce a radioisotope from the one or more targets;

wherein the target holder comprises a coolant inflow portion operable to receive a coolant flowing through the housing during radioisotope production so that the coolant removes heat from one or more targets held by the target holder and so that the coolant removes heat from the at least one curved window;

wherein the target holder comprises a coolant outflow portion operable to outlet coolant from the target holder after the coolant passes over and removes heat from the one or more targets and the at least one curved window; and wherein the at least one curved window comprises two curved windows coupled to the housing and positioned on opposite sides of the target holder, the two curved windows each having a convex curved surface oriented facing toward the target holder from opposite sides of the target holder, the two curved windows operable to transmit radiation from two different directions into the target holder for irradiation of the one or more targets from two different directions at the same time.

2. The apparatus of claim 1, wherein the convex surface of the at least one curved window has a partially spherical curvature.

3. The apparatus of claim 1, wherein the at least one curved window has a concave surface opposite from the convex surface.

4. The apparatus of claim 1, wherein the housing and target holder are arranged to provide a coolant from a channel between the convex surface of the curved window and an adjacent surface of a target held by the target holder inside the housing, such that the curved window is cooled by coolant flowing over the convex surface inside the housing.

5. The apparatus of claim 1, wherein the convex surface of the at least one curved window projects inwardly into a coolant flow path within the housing to cause increased heat transfer from the curved window to the coolant.

6. The apparatus of claim 1, wherein the target holder is configured to hold a plurality of targets inside the target holder.

7. The apparatus of claim 6, wherein the target holder is configured to hold a plurality of disk-shaped targets inside the target holder with the disk-shaped targets oriented substantially parallel to one another and spaced apart from one another to provide coolant flow paths between the targets.

8. The apparatus of claim 7, wherein the target holder comprises fins configured to hold the plurality of disk-shaped targets and configured to permit coolant flow between the fins and between the targets.

9. The apparatus of claim 1, wherein the target holder is configured to hold a plurality of packed spherical targets.

10. The apparatus of claim 1, wherein the target holder is configured to hold a single target that comprises a plurality of coolant flow channels passing through the single target.

11. The apparatus of claim 1, further comprising one or more targets comprising molybdenum mounted in the target holder.

12. The apparatus of claim 1, further comprising one or more targets comprising Mo-100 mounted in the target holder.

13. The apparatus of claim 1, further comprising a first electron beam source positioned to deliver a first electron beam at the at least one curved window, such that the first electron beam passes through the at least one curved window and then through at least one target inside the target holder.

14. The apparatus of claim 13, further comprising a second electron beam source positioned to deliver a second electron beam at a second curved window of the apparatus, such that the second electron beam passes through the second curved window and then through the at least one target inside the target holder.

15. The apparatus of claim 1, wherein the at least one curved window comprises an elemental metal or metal alloy.

16. The apparatus of claim 1, wherein the at least one curved window comprise a metal alloy selected from a precipitation hardened INCONEL alloy, an alloy of aluminum and beryllium, steel, a refractory metal alloy, an alloy of molybdenum and rhenium, an austenitic alloy, a martensitic-ferritic alloy, and an alloy of titanium and zirconium and molybdenum (TZM).

17. The apparatus of claim 1, wherein the at least one curved window comprises elemental aluminum.

18. The apparatus of claim 1, further comprising a cooling system coupled to the housing and configured to conduct coolant through the housing and the target holder.

19. The apparatus of claim 18, wherein the coolant comprises helium gas.

20. An apparatus for radioisotope production comprising:

a housing;

a target holder positioned inside the housing and configured to hold one or more targets in the housing for radioisotope production;

at least one curved window coupled to the housing and positioned adjacent to the target holder, the at least one curved window having a convex curved surface oriented facing into the housing toward the target holder, the at least one curved window operable to transmit radiation from outside the housing into the target holder for irradiation of one or more targets held by the target holder within the housing to produce a radioisotope from the one or more targets;

wherein the target holder comprises a coolant inflow portion operable to receive a coolant flowing through the housing during radioisotope production so that the coolant removes heat from one or more targets held by the target holder and so that the coolant removes heat from the at least one curved window; and wherein the target holder comprises a coolant outflow portion operable to outlet coolant from the target holder after the coolant passes over and removes heat from the one or more targets and the at least one curved window;

the apparatus further comprising a first electron beam source positioned to deliver a first electron beam at the at least one curved window, such that the first electron beam passes through the at least one curved window and then through at least one target inside the target holder; and the apparatus further comprising a second electron beam source positioned to deliver a second electron beam at a second curved window of the apparatus, such that the second electron beam passes through the second curved window and then through the at least one target inside the target holder.

* * * * *